US011299182B2

(12) United States Patent
Peloquin

(10) Patent No.: US 11,299,182 B2
(45) Date of Patent: Apr. 12, 2022

(54) SUSPENDED PUBLIC TRANSIT SYSTEM

(71) Applicant: Jean Victor Peloquin, Anaheim, CA (US)

(72) Inventor: Jean Victor Peloquin, Anaheim, CA (US)

( * ) Notice: Subject to any disclaimer, the term of this patent is extended or adjusted under 35 U.S.C. 154(b) by 0 days.

(21) Appl. No.: 17/337,381

(22) Filed: Jun. 2, 2021

(65) Prior Publication Data

US 2021/0370991 A1 Dec. 2, 2021

Related U.S. Application Data

(60) Provisional application No. 63/033,744, filed on Jun. 2, 2020.

(51) Int. Cl.

| | |
|---|---|
| ***B61B 1/00*** | (2006.01) |
| ***B61B 3/02*** | (2006.01) |
| ***B61D 49/00*** | (2006.01) |
| ***E01B 25/26*** | (2006.01) |
| ***B61D 1/06*** | (2006.01) |
| *B61J 1/10* | (2006.01) |

(52) U.S. Cl.

CPC ..... *B61B 3/02* (2013.01); *B61B 1/00* (2013.01); *B61D 1/06* (2013.01); *B61D 49/00* (2013.01); *E01B 25/26* (2013.01); *B61J 1/10* (2013.01)

(58) Field of Classification Search

CPC .... B61B 3/02; B61B 1/00; B61B 3/00; B61B 12/024; B61D 49/00; B61D 1/06; E01B 25/26; B61J 1/10; B61J 1/06

See application file for complete search history.

(56) References Cited

U.S. PATENT DOCUMENTS

| | | | | |
|---|---|---|---|---|
| 582,436 A * | 5/1897 | Ridgway | B65G 9/008 104/99 |
| 1,669,741 A | 4/1927 | Edson | |
| 1,980,867 A | 11/1934 | Lusse | |
| 2,976,817 A * | 3/1961 | Stapp | B61J 1/10 104/26.1 |

(Continued)

FOREIGN PATENT DOCUMENTS

| | | |
|---|---|---|
| CA | 2739534 | 3/2013 |
| CN | 106428028 | 8/2015 |

(Continued)

*Primary Examiner* — Mark T Le

(74) *Attorney, Agent, or Firm* — Cionca IP Law P.C.; Marin Cionca

(57) ABSTRACT

Provided herein are transit systems for travel overhead of streets, having: at least a first vehicle and a second vehicle; a main track on which the vehicles travel, the main track having a suspended overhead rail over the streets by a support structure, such that the vehicles travel at an elevated level overhead of street level; docking stations for the vehicles to lower to the street level for loading and/or unloading passengers and/or cargo; a two-position switch at each docking station, having cables enabling vertical movement of the vehicle, and a replacement track; wherein the two-position switch allows for docking of the first vehicle while the second vehicle passes the docked first vehicle, by enabling lowering of the first vehicle from the elevated level to the street level, and the replacement track providing a track portion for the second vehicle on which to pass the first vehicle.

10 Claims, 27 Drawing Sheets

(56) References Cited

U.S. PATENT DOCUMENTS

| | | | | | |
|---|---|---|---|---|---|
| 3,215,090 | A * | 11/1965 | Gibbs, Sr. | B61J 1/10 | 104/27 |
| 3,448,693 | A * | 6/1969 | Graham | B61J 1/10 | 104/48 |
| 3,847,085 | A * | 11/1974 | Rypinski | B61D 3/20 | 104/122 |
| 3,878,792 | A * | 4/1975 | Larson | B61L 23/005 | 104/101 |
| 5,086,904 | A * | 2/1992 | Yasutake | B23Q 7/1426 | 198/346.1 |
| 5,450,796 | A | 9/1995 | Sakagami | | |
| 6,178,891 | B1 | 1/2001 | Ostholt et al. | | |
| 7,246,559 | B2 | 7/2007 | Stromberg | | |
| 9,776,648 | B2 * | 10/2017 | Benjamin | B60T 7/22 | |
| 2010/0147183 | A1 * | 6/2010 | Weissbrodt | E01B 23/06 | 104/307 |
| 2019/0256110 | A1 | 8/2019 | Suarez Ajo | | |

FOREIGN PATENT DOCUMENTS

| | | | | |
|---|---|---|---|---|
| CN | 206091459 | | 3/2017 | |
| EP | 0143430 | | 6/1985 | |
| EP | 0553764 | | 1/1993 | |
| EP | 1279579 | | 5/2008 | |
| WO | 1995035221 | | 11/1994 | |
| WO | WO-0209995 | A1 * | 2/2002 | B61B 13/04 |
| WO | 2005063544 | | 12/2004 | |
| WO | 2006076792 | | 7/2006 | |
| WO | 2007059524 | | 5/2007 | |

* cited by examiner

SUSPENDED PUBLIC TRANSIT SYSTEM

CROSS-REFERENCE TO RELATED APPLICATIONS

This application claims the benefit of U.S. Provisional Application No. 63/033,744, filed Jun. 2, 2020, which is hereby incorporated by reference, to the extent that it is not conflicting with the present application.

BACKGROUND OF INVENTION

1. Field of the Invention

The invention relates generally to transportation, and more specifically to suspended transit of people and cargo.

2. Description of the Related Art

Public transit is typically inefficient and underutilized because of the many issues it has, which range from inconsistent schedules to being bogged down by rush hour traffic. However, to combat these issues current transportation methods would need to be expanded, which would mean widening freeways, adding carpool lanes, increasing the number of buses on the road, widening city streets, and adding metro rails and tunnels, which are all very costly solutions. Most of these solutions also add to the current pollution problem because of the excessive carbon emissions they produce. These transit methods can also be an inefficient use of time because of the time used sitting in traffic and the time it takes to load and unload passengers from each public transit vehicle.

Currently, public transit is only as good as the surface streets it can take because of the high volume of traffic. Furthermore, public transit, such as metro lines, can reduce the amount of surface street traffic; however, they are underground systems, which would be a costly construction job to expand. Additionally, current public transit is usually unreliable for users because of the constant delays from traffic and each stop taking too long for passengers to load and unload.

Therefore, there is a need to solve the problems described above by proving a more efficient public transit system.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description.

In an aspect, a public transit system is provided, the system being suspended on an overhead monorail. The overhead suspension allows the passenger cars to not interfere with existing modes of transportation. Thus, an advantage is being above the traffic that would disrupt the public transit system. Another advantage would be a reduction in traffic congestion because the public transit system can replace other modes of public transportation, such as buses, taxes, trolleys, delivery trucks, ride share vehicles, cars, etc., therefore reducing the number of vehicles on the road.

In another aspect, a public transit system is provided, the public transit system being electrically driven. The passenger car of the public transit system being electrically driven would produce zero carbon emissions and have a reduction in noise pollution. The passenger car being electrically driven would also decrease the maintenance necessary to maintain the system, such as changing filters, oil, and other fluids, further reducing costs. Thus, some advantages are a fully green system, limited noise pollution, and a reduced rider cost. Another advantage is increase rider participation due to the reduced cost for riders.

In another aspect, a public transit system is provided, the system having a two-position switch. The two-position switch would allow the passenger car to move laterally, in both directions, off the main monorail track. The passenger car would move out of the way of continuing passenger cars so each passenger car would not be held up by the loading and unloading of each passenger car in front of them. Thus, an advantage is more time efficient travel without the delay of passenger loading and unloading.

In another aspect, a public transit system is provided, the system having elevator-type mechanism attached to the passenger car. The elevator-type mechanism would allow the passenger car to descend from the suspended height down to street level. Once the passenger car is at street level the passengers can easily depart onto the city sidewalk, similar to getting off a bus. Thus, an advantage is faster passenger unloading and it would also not block other passenger cars from reaching the next destination.

In another aspect, a public transit system is provided, the system having a pivotal mechanism that allows for ninety-degree turns attached to the passenger car. The pivotal mechanism would allow the passenger car to pivot around tight corners and parallel current street configurations. Thus, an advantage is being able to traverse ninety-degree turns without disrupting current city infrastructure.

In another aspect, a public transit system is provided, the passenger car of the public transit system having a designated cargo compartment. The designated cargo compartment would allow parcels to be transported to more localized destinations. This would eliminate the need for parcel trucks traveling from parcel centers to users' doors. The public transit system would be able to deliver parcels to a relatively closer location, which then for example a bike messenger could deliver the package to its final destination. The public transit system disclosed herein can be used for last-mile delivery of cargo and packages. Thus, an advantage is less vehicles on the road and therefore less pollution.

In another aspect, a transit system for travel overhead of streets is provided, having: vehicles, comprising at least a first vehicle and a second vehicle; a main track on which the vehicles travel, the main track having a suspended overhead rail over the streets by a support structure, such that the vehicles travel at an elevated level overhead of street level; docking stations for the vehicles to lower to the street level for loading and/or unloading passengers and/or cargo; a two-position switch at each docking station, having cables enabling vertical movement of the vehicle, and a replacement track; wherein the two-position switch allows for docking of the first vehicle while the second vehicle passes the docked first vehicle, by enabling lowering of the first vehicle from the elevated level to the street level, and the replacement track providing a track portion for the second vehicle on which to pass the first vehicle.

In another aspect, a vehicle is provided, having: a front end; a rear end; a first level comprising a seating section at the front end and a cargo loading area at the rear end; a second level above the first level, comprising a cargo storage area above the seating section, the cargo storage area having a first moving floor; the cargo loading area comprising an elevator platform having a second moving floor, and an elevator track in an interior wall of the vehicle; the elevator platform being capable of vertical movement between the first level and the second level via the elevator track; wherein the first moving floor and the second moving floor each are capable of horizontal movement to transport cargo from the front end to the rear end or from the rear end to the front end; wherein movement of the first moving floor can transport cargo from the cargo loading area onto the cargo storage area, and movement of the second moving floor can transport cargo from the cargo loading area onto the cargo storage area; and wherein the rear end comprises a first door to an exterior of the vehicle, such that loading and unloading of the cargo can be performed when the elevator platform is at the first level and the first door is open to the exterior of the vehicle.

In another aspect, a public transit system for travel overhead of streets is provided, having: vehicles, comprising at least a first vehicle and a second vehicle; a main track on which the vehicles travel, the main track having an overhead rail suspended over the streets by a support structure, such that the vehicles travel at an elevated level overhead of street level; docking stations for the vehicles to lower to the street level for loading and/or unloading passengers and/or cargo; the main track comprising movable intersection switches at intersections of the streets, such that the vehicles are enabled to travel straight or make a turn at the intersections.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
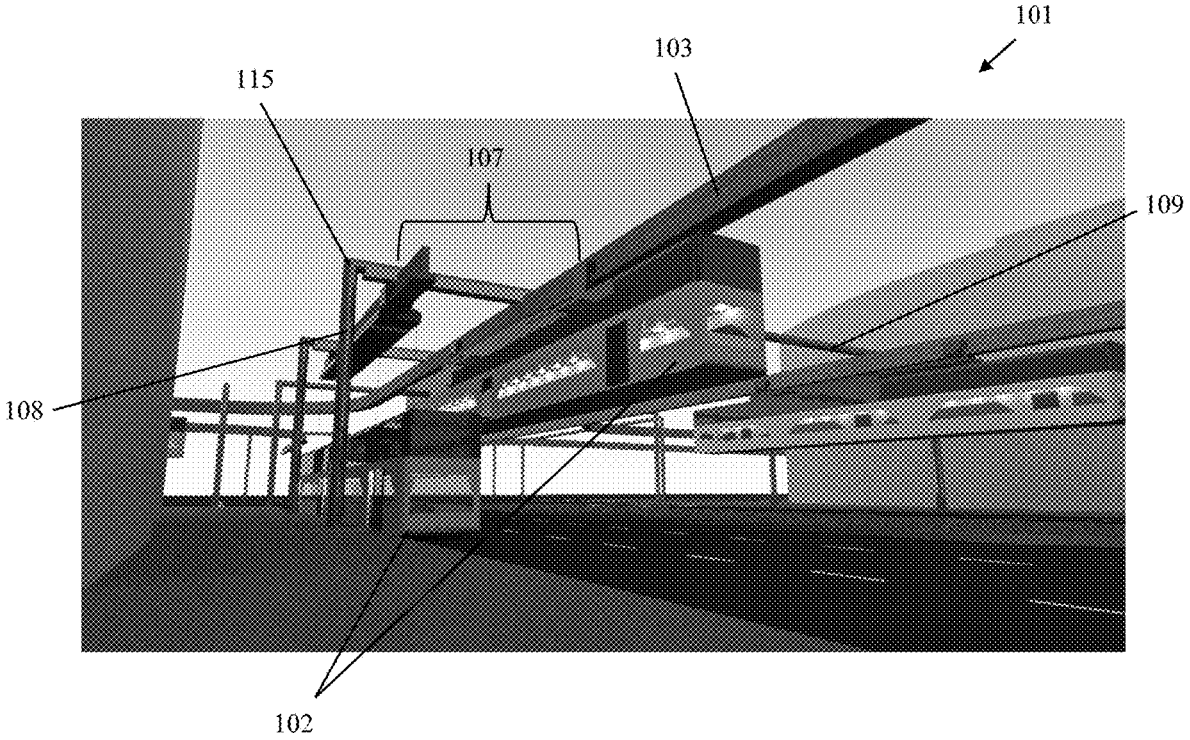
FIG. 1 illustrates the perspective view of a public transit system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

FIG. 1 illustrates the perspective view of a public transit system 101, according to an aspect. The transportation system 101 is shown having a public transit vehicle ("passenger car", "public transit passenger car," "transit vehicle") 102. The public transit vehicle 102 may travel on an overhead rail ("public transit rail", "main rail", "rail", "track", "main track", "public transit track", "elevated track", "main monorail track") 103 and may be suspended above current streets. The public transit system 101 may be implemented in any city infrastructure by installing a main track 103 supported by a support structure 115. The support structure 115 may have a plurality of support columns 108 and beams 109 to suspend the main track 103. A support column 108 may be installed on a sidewalk with a corresponding support column 101 across the street having a support beam 109 connecting them overhead. This support structure 115 configuration may be repeated down the city streets. The public transit track 103 may be attached underneath the beams 109 throughout the system. The overhead rail 103 may have a two-position switch 107 near loading and unloading zones, which may allow for more efficient loading and unloading of passengers and cargo. The two-position switch 107 may also avoid interrupting traffic on the track of other passenger cars 102. The public transit system 101 may also allow for less delays caused by unforeseen loading and unloading issues because of the two-position switch 107. The two-position switch 107 will be described in more detail in reference to FIG. 4.

Usually, and depending on the time of the day, there may be unpredictable delays for typical public transit systems. The loading and unloading of passengers may contribute to these delays greatly, while other delays may be traffic congestion, accessibility for handicap passengers, bicycles in baggage areas and any other unforeseen delays. Furthermore, these unpredictable delays reduce the ability for metro buses and other public transit systems to arrive on time. These delays may be reduced by the unimpeded rail of the a two-position switch 107, which may allow for passenger cars 102 that have to arrive at the next destination to pass the passenger car 102 that is being loaded/unloaded below. This may allow for the other passenger car 102 to arrive on or close to on time at its next stop.

The public transit system 101 having an elevated suspended monorail also may allow for less interference from the traffic congestion beneath it. Current public transit methods may be impeded by road conditions, while the public transit system 101 may travel without delay because it is elevated over the congested roads. The public transit system 101 may have an electrically driven motor or electrically driven motor wheels, which may allow for minimum pollutants and less noise pollution. The public transit system 101 having an electric motor may require less maintenance and be safer because the public transit system 101 suspends over traffic and thus may not be involved in surface street accidents. Furthermore, the elevated track 103 may allow for the passenger car 102 and passengers to have an expanded view of the environment making for a more enjoyable ride. In most locations, the public transit system 101 may eliminate the need for buses, cars, taxis, trolleys, and rideshare, which may reduce traffic exponentially.

The public transit system 101 also may require less maintenance due to it being an electric system thus changing filters, oil, and other fluids is not necessary. The public transit system 101 also may require less maintenance because there are no tire rims or undercarriage and rusted parts may not be an issue because the system does not interact with the salted streets. These issues typically require routine maintenance. The public transit system 101 also may not have exterior graffiti most other transportation modes have because the public transit system 101 is elevated. The public transit system 101 may also have a reduced insurance cost because of the system's improved safety compared to other transportation methods as described herein. This may also reduce the carbon emissions because it may not be necessary to manufacture the other public transit methods use. As described herein, the cost per passenger per mile may be reduced due to these reductions in the overall system costs.

Figure 2:
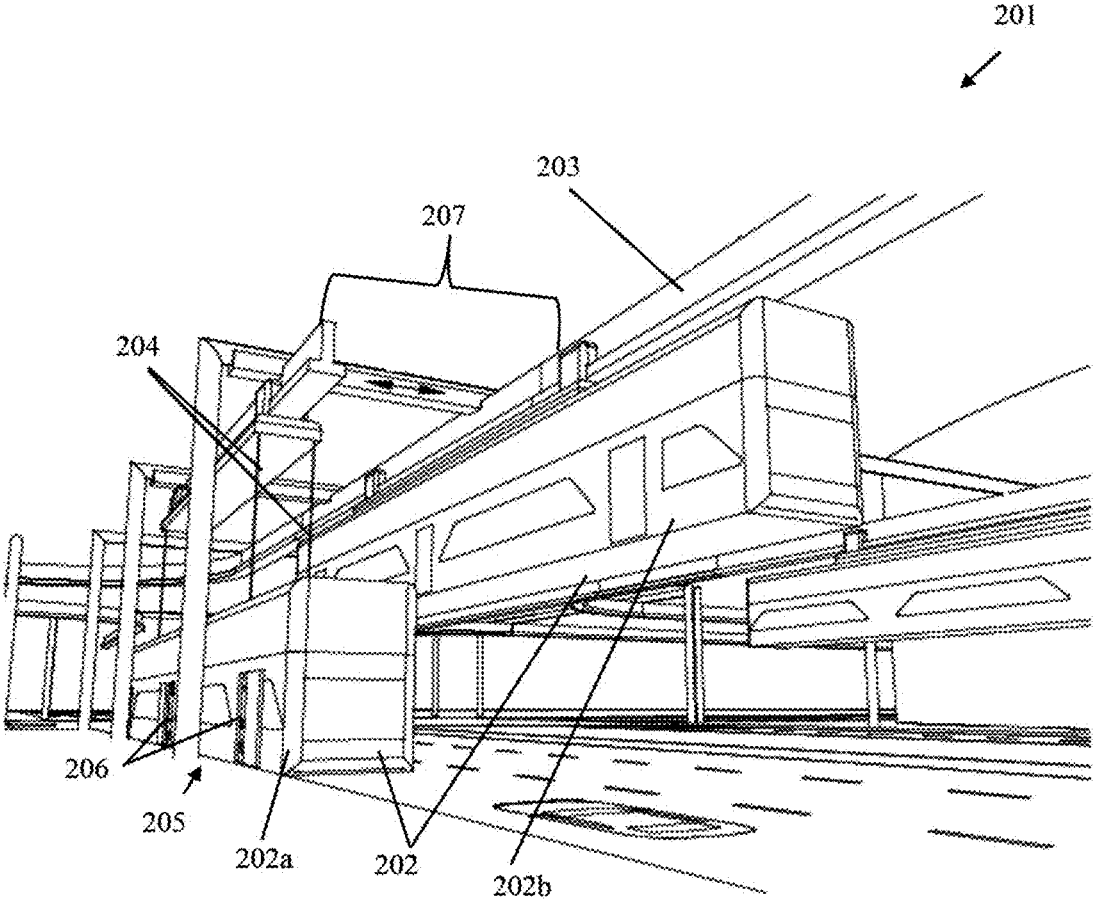
FIG. 2 illustrates the perspective view of a public transit system, according to an aspect.

Shown in FIG. 2 is the perspective view of a public transit system 201, according to an aspect. In an example, the passenger car 202 may be extended downward to street level to allow for passenger loading and unloading. The public transit vehicle 202 may lower to street level via an elevator-type mechanism. For example, the passenger car 202 may extend down to street level by the use of elevator cables 204. The elevator cables 204 may be attached to the passenger car 202 and may allow the car to slowly descend to the docking station ("street sidewalk," "docking zone," "loading/unloading station" or "loading/unloading zone") 205. For example, the public transit system 201 may have loading/unloading zones 205 on current sidewalks, similar to current bus stops. Once at street level, the passenger car doors 206 would open and the passengers may load and unload to and from the passenger car 202. For example, the two-position switch 207 is shown to move the passenger car 202*a* away from the main rail to allow passenger car 202*a* to be out of the way of the other passenger car 202*b* while it is loading and unloading. The two-position switch 207 will be described in more detail in reference to FIG. 4.

For example, the passenger car 202 may descend to street level and dock in the street while passengers unload and load from a loading/unloading station on the sidewalk. The passenger car 202 may dock in the street in a designated spot, similar to a bus stop for example. Furthermore, the passenger car 202 being equipped with suitable safety sensors to detect the presence of vehicles, people, or various objects within the docking zone. In an example, the safety sensors may be tripped, which may automatically stop the descent of the passenger car 202 until these objects are removed.

Figure 3:
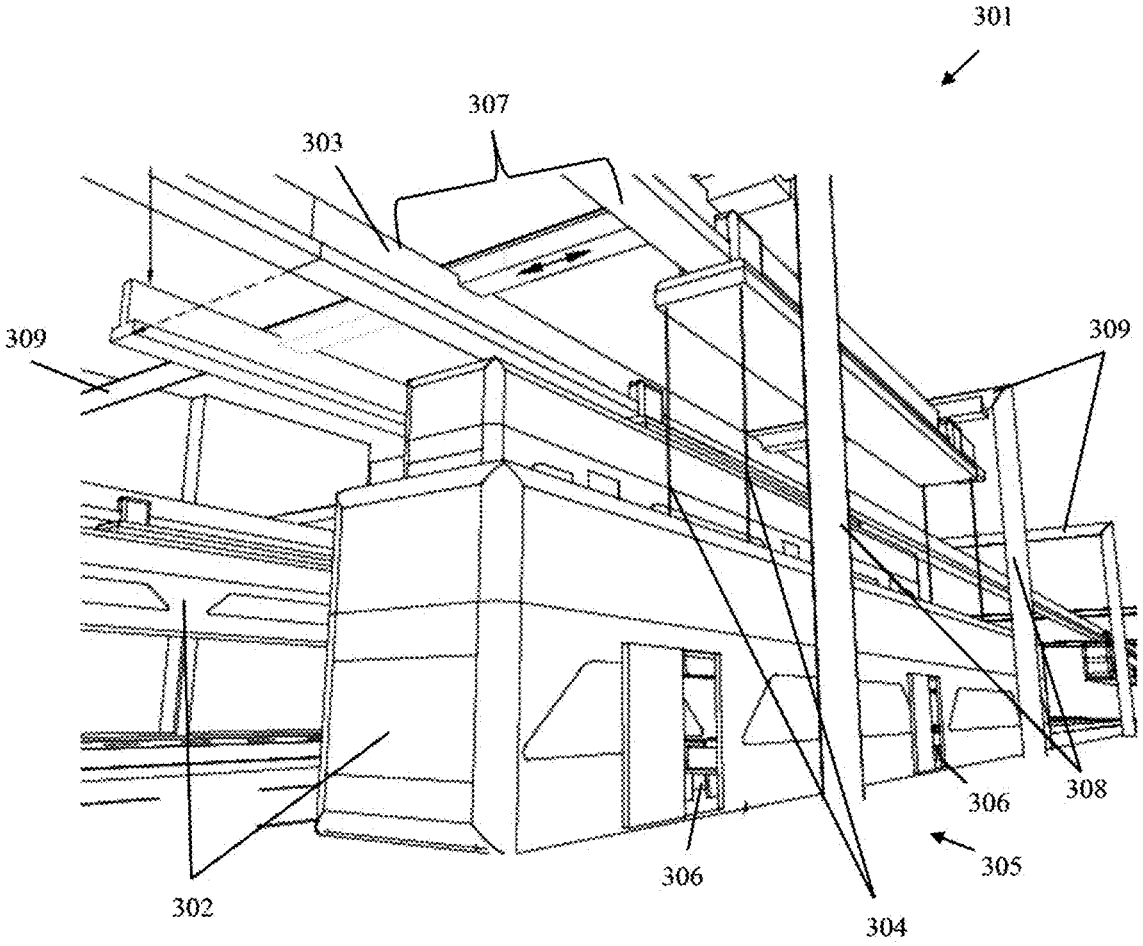
FIG. 3 illustrates the perspective view of a public transit passenger car, according to an aspect.

FIG. 3 illustrates the perspective view of a public transit passenger car 302, according to an aspect. As shown in FIG. 3, the passenger car 302 is on the reverse side of the street as the passenger car 302 in FIG. 2. In an example, the passenger cars 302 may travel in the direction of the traffic beneath them. This may also allow the passengers to easily exit the public transit passenger car 302 and travel to their final destination. FIG. 3 also shows the two-position switch 307, which may allow for efficient passenger loading and unloading and will be discussed in more detail in reference to FIG. 4. When the passenger car 302 stops to load and unload, the controller of the passenger car 302 may have two options to move the passenger car 302, either right or left. This may be accomplished by the overhead two-position switch 307, which may move the passenger car 302 right or left in either direction. For example, when moving to the side, the passenger car 302 may dock to an elevated passenger platform for loading and unloading. In another example, when moving to the side, the passenger car 302 may lower to the street below allowing for ground level loading and unloading. Lowering and raising of the passenger 302 can be done via the elevator cables 304. The two-position switch 307 may allow the track 303 to be continuous for through traffic and the passing of a second car or vehicle, while a portion of the track 303 may be in use for loading and unloading a stopped passenger car 302.

Figure 4:
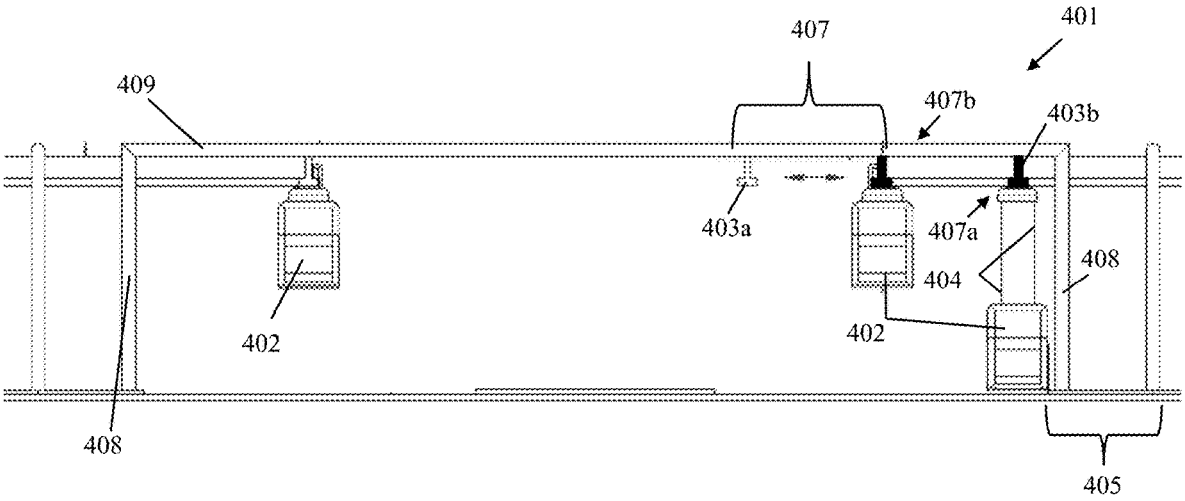
FIG. 4 illustrates the elevated front view of a public transit system, according to an aspect.

FIG. 4 illustrates the elevated front view of a public transit system 401, according to an aspect. In an example, the two-position switch 407 may shift the passenger car 402 from the main track 403 to the loading and unloading position. Once in the loading/unloading position 407*a* the passenger car 402 may lower down to the loading/unloading zone 405 via an elevator-type mechanism, which may include elevator cables 404. The two-position switch 407 may have two positions, a loading/unloading position 407*a* and a traveling position 407*b*. The public transit vehicle 402 may move sideways away from the track 403 together with a corresponding portion of the track 403*b* while a replacement track 403*a* portion temporarily completes the track. This allows traffic to continue on the track 403 while passengers and cargo are loaded and unloaded. In another example, as the public transit vehicle 402 moves sideways, the public transit vehicle may engage with a raised platform for loading and unloading.

For example, when there is no passenger car 402 being loaded or unloaded, the first track portion 403*a* of the two-position switch 407 may not be in use as shown in FIG. 4. When the passenger car 402 needs to make a stop for loading and unloading, the second track portion 403*b* of the two-position switch 407 may move to the loading and unloading zone 405, as shown in FIG. 4. The structure of the public transit system 401 may consist of support beams 409 coupled with support columns 408, with the two-position switch 407 attached to the support beams 409. The support beams 409 may have the main track 403 attached beneath the beam to be able to suspend the passenger car 402 as described herein.

Figure 5:
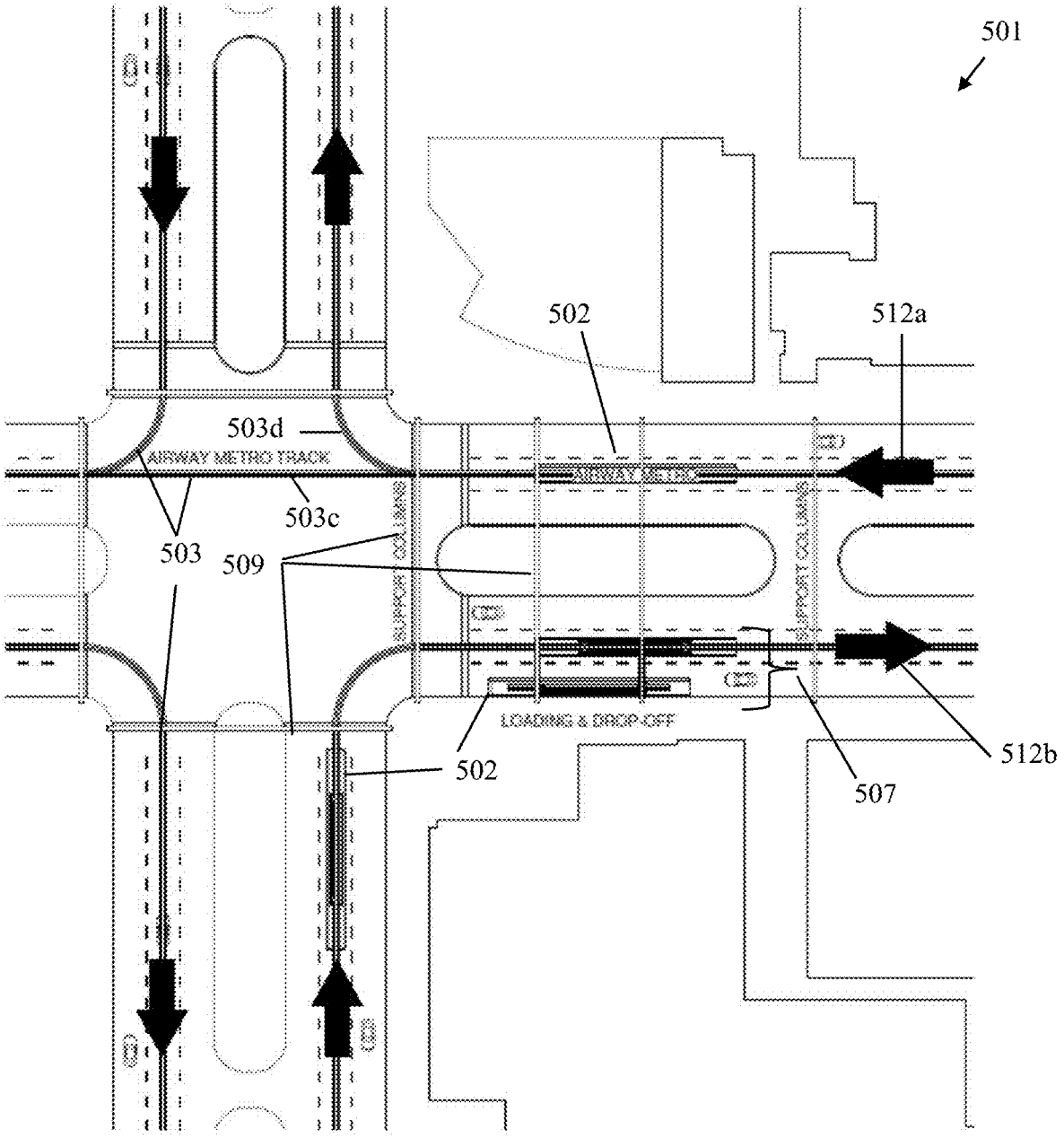
FIG. 5 illustrates the top view of a public transit system, according to an aspect.

FIG. 5 illustrates the top view of a public transit system 501, according to an aspect. For example, as shown, the public transit system 501 may have main rails 503 above city streets. The public transit system 501 may have main rails 503 running above city streets in the direction of traffic shown by arrows 512*a* and 512*b*. The public transit system 501 may travel along the main rails 503, when nearing intersections, the main rail 503 may have a turning switch allowing passenger cars to continue onto the straight portion 503*c* of the rail or make a 90° turn and enter onto a straight track in another direction 503*d*. For example, the front and rear passenger car wheels, not shown, may be guided on the track by an electronic sensor, which may turn the wheels at the appropriate time. The electric sensor (not shown) may register when a turn is coming and adjust the wheels accordingly.

Figure 6:
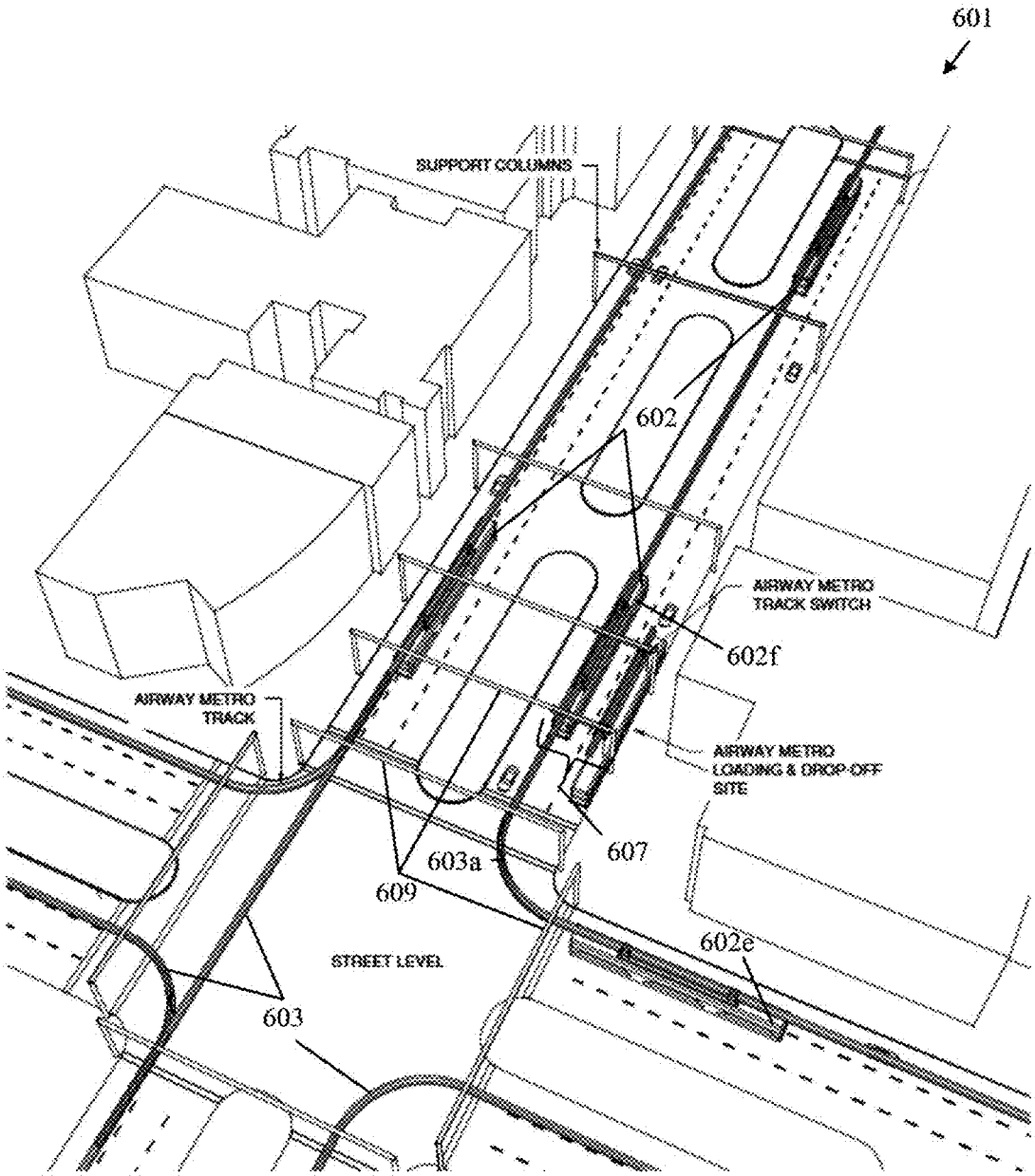
FIG. 6 illustrates the perspective view of a public transit system, according to an aspect.

FIG. 6 illustrates the perspective view of the public transit system 601, according to an aspect. As shown, the public transit system 601 may take tight turns by using pivotal wheels, which will be described in more detail in reference to FIGS. 8A and 8B. The passenger car 602 is shown traversing a right turn 603*a* by the passenger car 602*e* and passenger car 602*f* because the passenger cars 602 follow the main track 603.

As described herein, the turning may be accomplished by a pivotal mechanism or by pivotally attaching the electric motor drive wheels. The public transit vehicle 502, 602 may also move in a sideways direction, which would allow the public transit vehicle to lower, via an elevator-type mechanism, for street-level loading and unloading. The public transit vehicle 502, 602 would also have driving wheels associated with a swivel/pivotal mechanism that allows for ninety degree turns, for example the turn 603*a*, while the passenger car 502, 602 may continuously be engaged with the overhead rail. The public transit vehicle 502, 602 may also have the ability to store and transport parcels and other such cargo for package delivery companies.

Figure 7A:
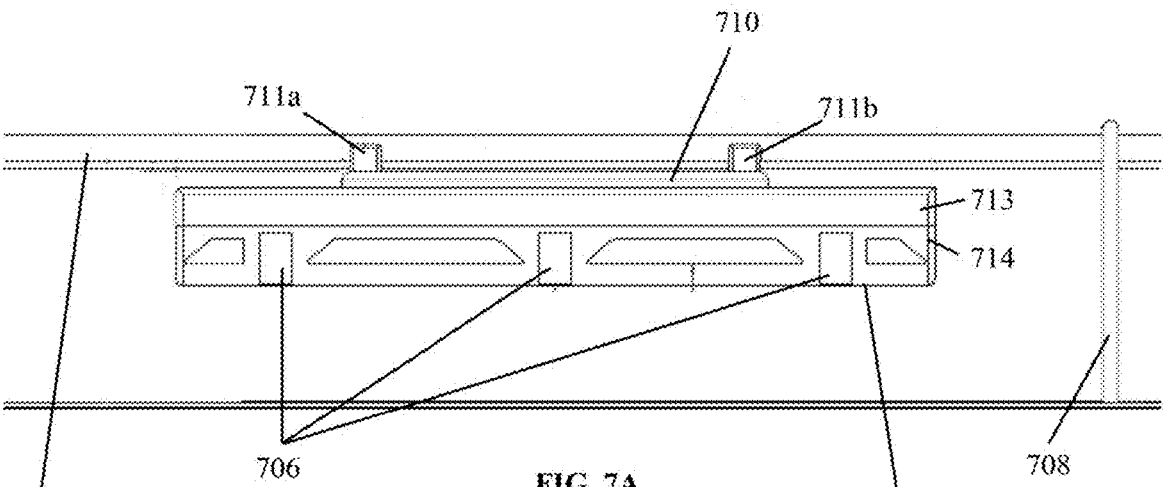
FIG. 7A illustrates the side view of a public transit passenger car, according to an aspect.

FIG. 7A illustrates the side view of a public transit passenger car 702, according to an aspect. Dimensions of the public transit passenger car 702 may be shown in FIG. 7A, but it should be noted that all the dimensions shown in the figures are shown as an example. It should also be understood that deviation from those dimensions can be made and still stay in the spirit and scope of the invention. As shown in FIG. 7A, the total length of the public transit passenger car 702 being 100' is used as an example to account for a space to hold 100 passengers and their belongings. The height of the cargo compartment 713 may be 6' for example, while height of the passenger cabin 714 may be 8' for example. The passenger car 702 may have a distance of 16' or higher from the bottom of the vehicle to the ground for example. The passenger car 702 may have a total height of about 19' to about 23' from the bottom of the vehicle to the top of the wheel attachments 711*a* and 711*b* for example. The support post 708 of the public transit system is shown having a height of about 38' or higher for example and a width of 2' or greater for example. The distance from the top of the passenger car 702 to the track 703 is shown being about 4' or greater in an example.

In an example, the public transit vehicle 702 may use electric motor drive wheels to reduce overall costs and pollution. The electric motor drive wheel housing 711 may be attached at about 25% from the front, and the rear set located approximately 25% forward from the rear of the passenger car 702. The electric motor drive wheels with wheel housing 711 may be attached 25% from the ends to allow for better stability and improved turning radius during traveling, this allows for a more balanced and secure connection between the passenger car 702 and the main track 703. The placement may also allow for better traction, which allows the power that is produced from each electric motor drive wheel to propel the passenger car 702 forward.

Figure 7B:
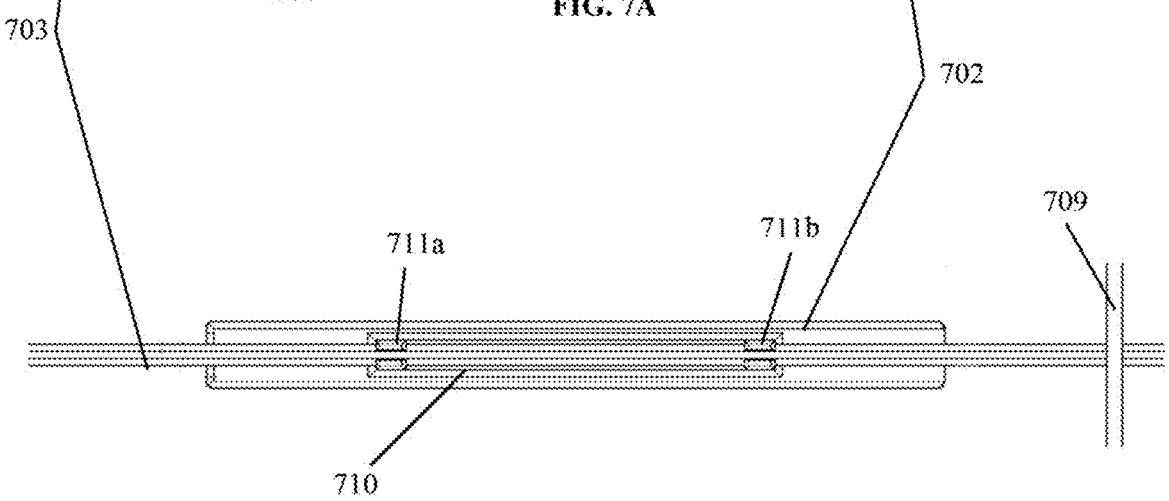
FIG. 7B illustrates the top view of a public transit passenger car, according to an aspect.

FIG. 7B illustrates the top view of a public transit passenger car 702, according to an aspect. Dimensions of the public transit passenger car 702 may be shown in FIG. 7B, but it should be noted that all the dimensions shown in the figures are shown as an example. It should also be understood that deviation from those dimensions can be made and still stay in the spirit and scope of the invention. The total width of the public transit passenger car 702 being 9' is used as an example to account for space for the 100 passengers and their belongings. The public transit passenger car 702 may attach to the main rail 703 at a front attachment 711*a* and a back attachment 711*b*, which may be 50' apart for example. The elevator cable mechanism 710 may have a length of about 54' to about 60' for example and a width of 6' for example. The elevator cable mechanism 710 may house the elevator cables along with an air conditioning unit or any of electronic components for example. The width of the track 703 is shown as about 3' to about 5' for example.

Figure 8A:
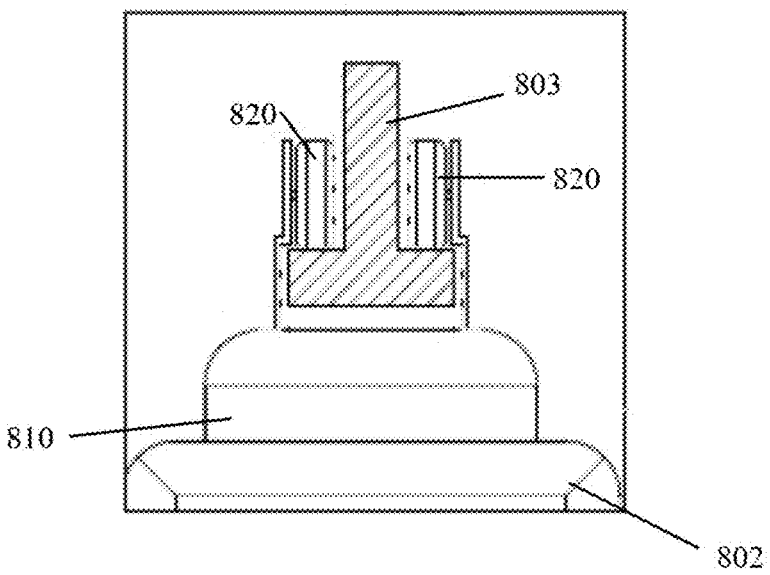
FIG. 8A illustrates the cross-section view of a public transit rail, according to an aspect.

FIG. 8A illustrates the cross-section view of a public transit rail 803, according to an aspect. For example, the public transit vehicle 802 may use electric motor drive wheels 820 to reduce overall costs and pollution. The electric motor drive wheels 820 may be attached at about 25% from the front, and the rear set located approximately 25% forward from the rear of the passenger car 802, as described in more detail in reference to FIGS. 7A and 7B. As shown, the electric motor drive wheels 820 may be attached on both sides of the main track 803. In an example, there may be four electric motor drive wheels 820 per passenger car 802 to propel the vehicle on the rail 803. The wheels each have a smaller motor to allow for efficient traveling by providing a more energy efficient transportation system, in contrast to a traditional ground transportation system such as a ground bus system, and the like. This also may contribute to the placement of the electric motor drive wheels 820 to allow for enough power to propel the passenger vehicle 802. The electric motor drive wheels 820 may also allow for more energy efficient turning because the of the motors being able to individually control each wheel, meaning every wheel 820 may not be at full power when turning. For example, the electric motor driven wheels 820 may have pneumatic tires resting on each side of the horizontal portion of the above "T" rail 803.

The electric motor drive wheels 820 may allow the public transit passenger car 820 to follow the narrow turn portions of the track. The electric motor drive wheels 820 may also be attached pivotally to the passenger car 802 to further allow for the tight maneuvers. The electric motor drive wheels 820 may be attached to elevator cable mechanism 810 to allow the wheels to stay engaged with the track 803 while the passenger car 802 is lowered to street level.

Dimensions of the public transit passenger car 802 may be shown in FIG. 8A, but it should be noted that all the dimensions shown in the figures are shown as an example. It should also be understood that deviation from those dimensions can be made and still stay in the spirit and scope of the invention. The main rail 803, may be an upside-down T-shape and is shown having a width of 3' or greater for example and a height of about 5' to about 7'. The cross portion of T of the main rail 803 is shown having a width of 1' or greater for example, while the thickness of the T of the main rail 803 is also shown having a width of 1' or greater for example.

Figure 8B:
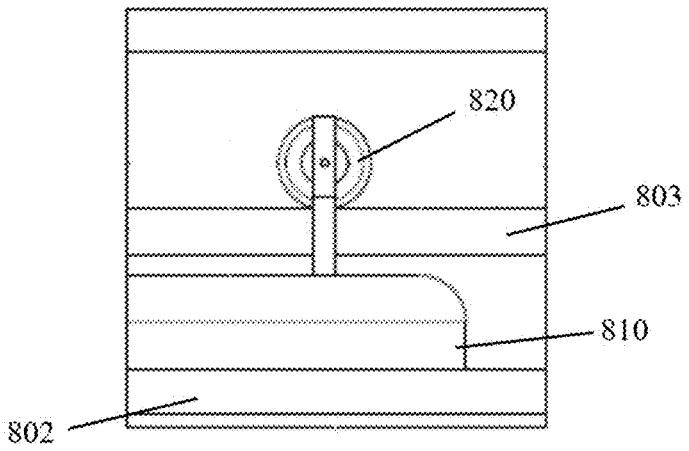
FIG. 8B illustrates the side view of a public transit rail, according to an aspect.

FIG. 8B illustrates the side view of a of a public transit rail 803 without wheel housing, according to an aspect. The dimensions of the public transit passenger car 802 may be shown in FIG. 8B, but it should be noted that all the dimensions shown in the figures are shown as an example. It should also be understood that deviation from those dimensions can be made and still stay in the spirit and scope of the invention. The electric motor drive wheel 820 is shown to have a diameter of 2' for example. The electric motor drive wheel 820 may be placed at about 25% from the front, and the rear set located approximately 25% forward from the rear of the passenger car 802. The electric motor drive wheels 820 may each have an electric motor to propel each wheel independently.

Figure 9:
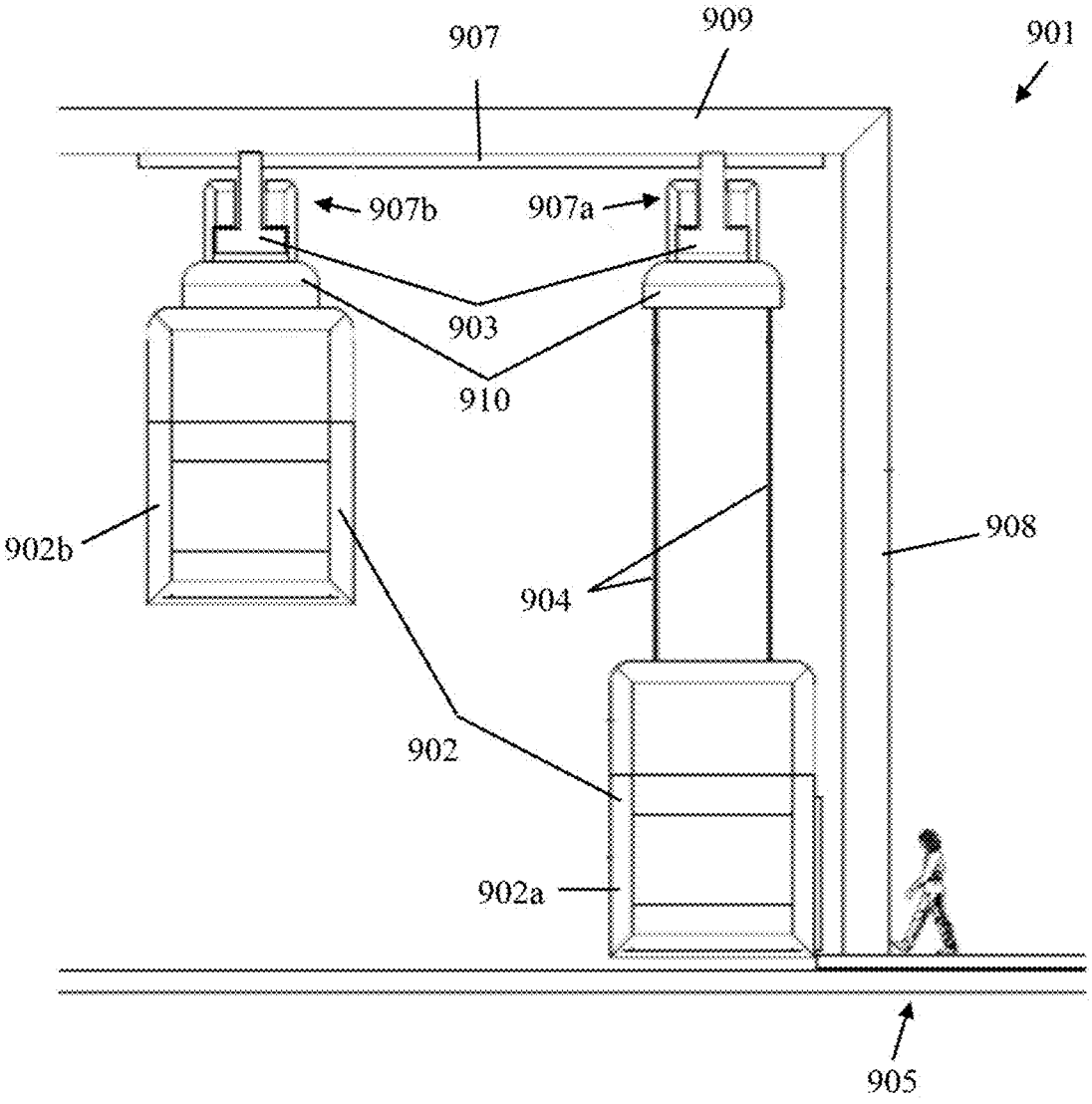
FIG. 9 illustrates the front view of a public transit system, according to an aspect.

FIG. 9 illustrates the front view of a public transit system 901, according to an aspect. The two-position switch 907 may allow for a first passenger car 902*a* and a second passenger car 902*b* as shown to both be on the rail 903. The first passenger car 902*a* and the second passenger car 902*b* may be on the two-position switch 907 with the first passenger car 902*a* in the loading/unloading position 907*a* and the second passenger car 902*b* in the traveling position 907*b*. The first passenger car 902*a* may be extended downward on elevator cables 904 at a passenger loading and unloading zone 905. The second passenger car 902*b* may then stay on the main rail and pass the first passenger car 902*a* at the passenger loading and unloading zone 905.

Dimensions of the public transit passenger car 902 may be shown in FIG. 9, but it should be noted that all the dimensions shown in the figures are shown as an example. It should also be understood that deviation from those dimensions can be made and still stay in the spirit and scope of the invention. The elevator cable mechanism 910 is shown having a width of 6' for example and a height of 2'. As shown, the width of the passenger car 902 may be 9' for example.

For example, the public transit passenger car 902 may expand outward an additional width on each side to expand the passenger cabin. While the public transit passenger car 902 expands, the passenger seats may stay affixed to the expanding section of the passenger cabin. In an example, the passenger seats may also expand from two-passenger seats to four-passenger seats by having another two-passenger seat nested within the existing two passenger seat. The existing two passenger seats may be fixed to the passenger car wall and as the passenger car wall starts to expand outward the additional two-passenger seat may be exposed. This may allow for additional seats on each side of the passenger cabin. The center space may become a larger standing area where passengers may stand during short rides and may hold the overhead handrails for safety purposes. The expanded passenger car 902 may allow for transport for a larger number of passengers because of the increase in passenger standing and sitting space. This may be beneficial for high traffic times and when large venues are anticipating or releasing large amounts of people.

Figure 10A:
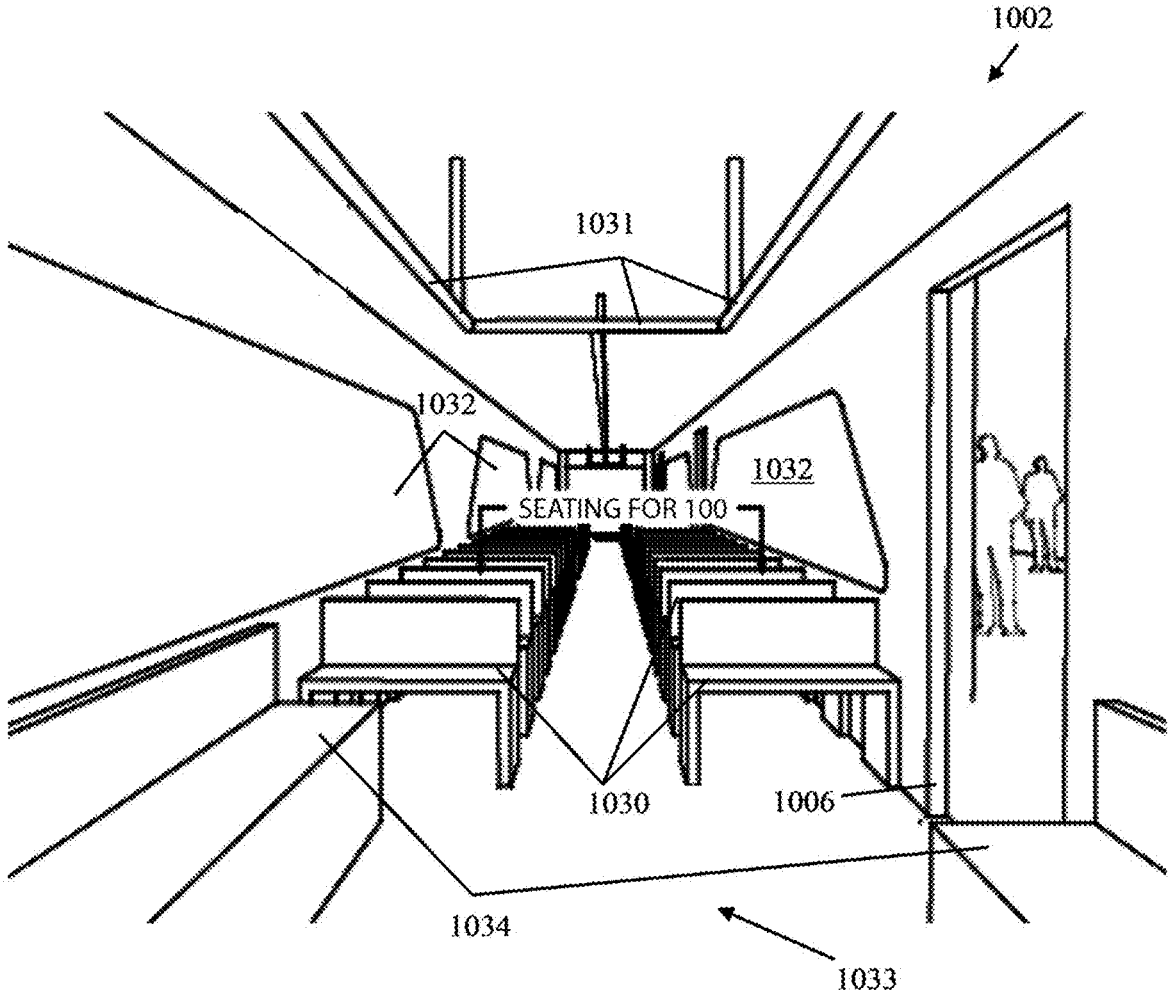
FIGS. 10A-10B illustrate the perspective views of the interior of a public transit passenger car, according to an aspect.
Figure 10B:
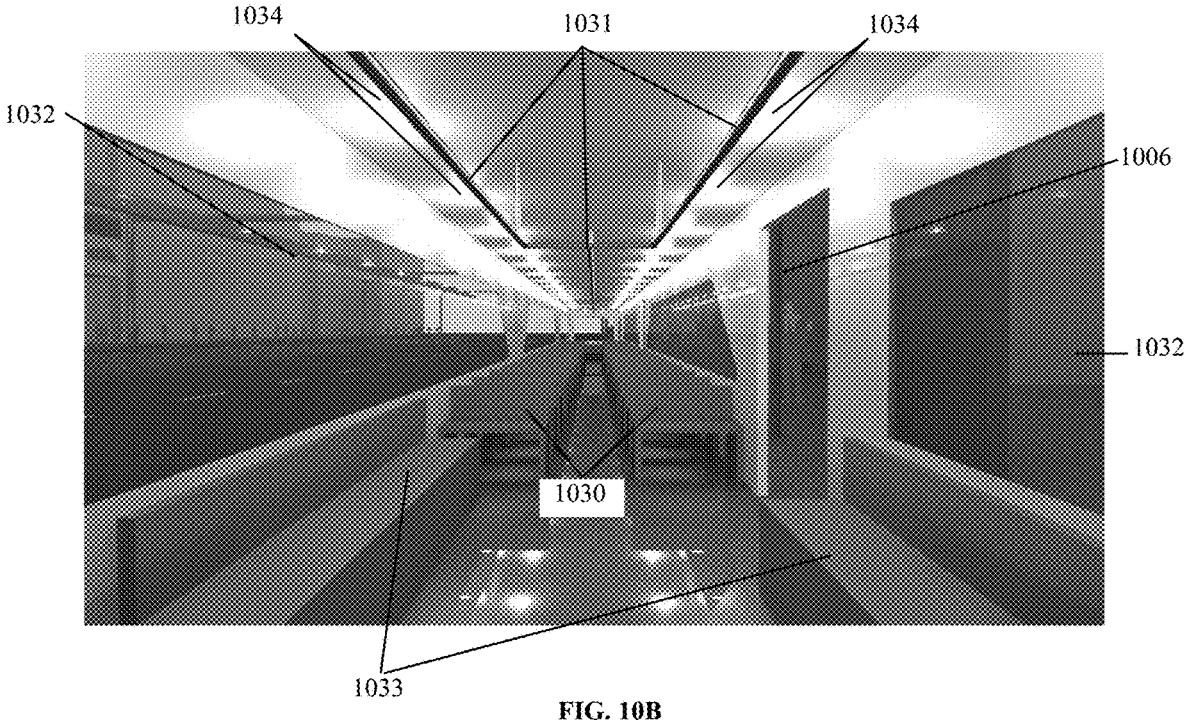

FIGS. 10A-10B illustrate the perspective views of the interior of a public transit passenger car 1002, according to an aspect. The public transit passenger car 1002 may have seats 1030 for 100 people, with each seat 1030 having room for two passengers. The seats may be arranged in two per row and may have 25 rows. In an example, there may also be bench seats 1034 near the doors 1006. For example, passengers my use the area 1033 as standing room and travel while holding the handrails 1031. In another example, the handrails 1031 may also have straphangers for the passengers to easily hold. These elements may allow the passengers to be more stable while standing during travel, thus making the system safer. The public transit passenger car 1002 may have a layout similar to other public transport systems; however, because of its larger size it may transport more people compared to other systems. The larger passenger area may also provide more public transport, thus reducing additional pollution from other modes of transportation. The public transit passenger car 1002 may also have windows 1032 for the passengers to have the ability to look out from. For example, the interior of the public transit passenger car 1002 may have overhead lights 1034 as shown.

Figure 11:
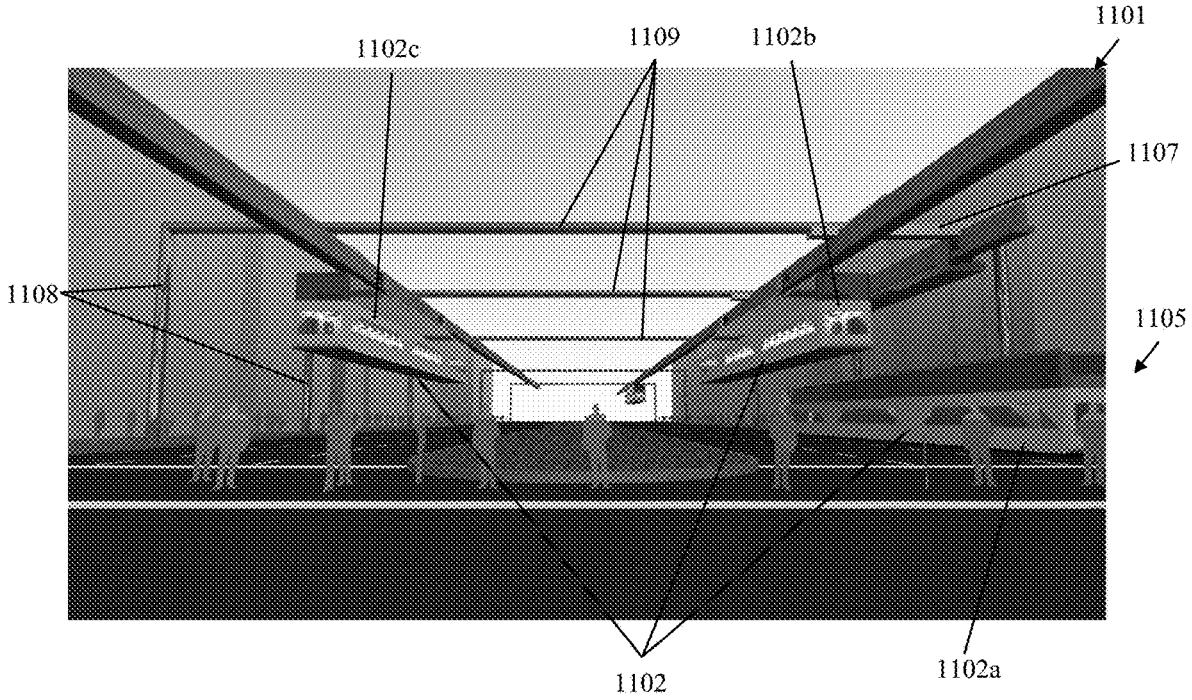
FIG. 11 illustrates the perspective view of a public transit system installed over a city street, according to an aspect.

FIG. 11 illustrates the perspective view of a public transit system 1101 installed over a city street, according to an aspect. For example, the public transit system 1101 is shown over a six-lane street with a center median. However, public transit system 1101 may be constructed over any city street. In another example, if the streets are too narrow the public transit system 1101 may only have one direction of passenger cars 1102 on any given street, while on another street the system 1101 may have passenger cars 1102 traveling in the opposite direction.

As shown, the passenger car 1102*a* is docked while passenger cars 1102*b* and 1102*c* are continuing on their route. The passenger car 1102*a* may move towards the docking station 1105 by the two-position switch 1107 as described in regard to FIG. 9. Again, having the two-position switch 1107 may allow for faster travel because the passenger cars 1102 are never impeded by various delays caused by other passenger cars 1102.

Figure 12:
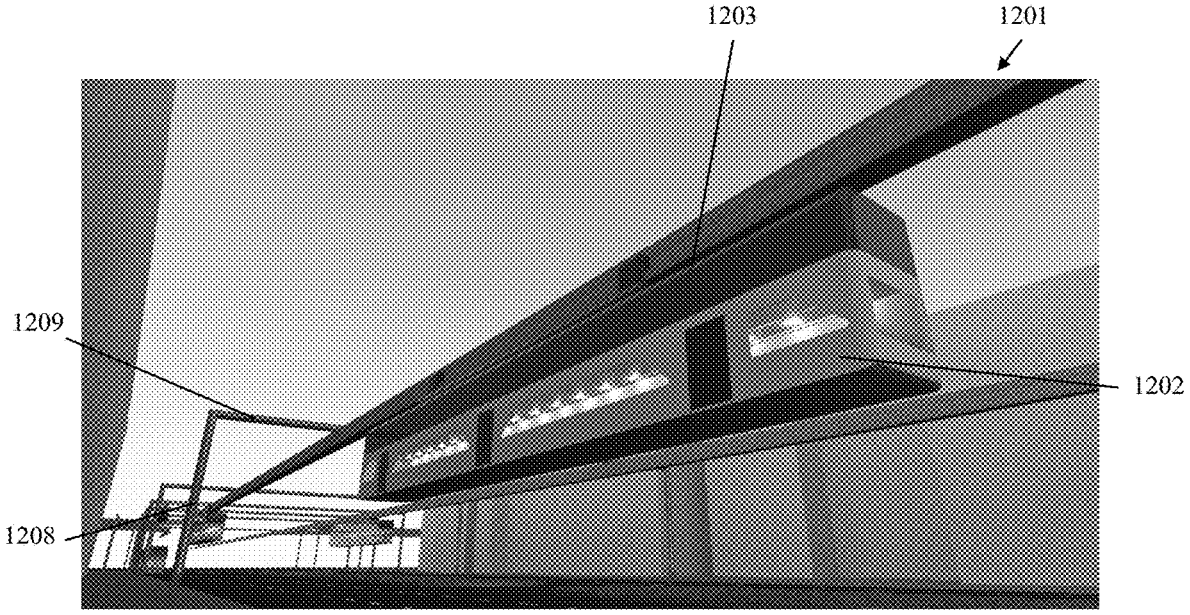
FIG. 12 illustrates the perspective view of a public transit system with a passenger car travelling along the main rail, according to an aspect.

FIG. 12 illustrates the perspective view of a public transit system 1201 with a passenger car 1202 travelling along the main rail 1203, according to an aspect. For example, the passenger car 1202 may have a route to stop at every other docking station to further increase efficient loading and unloading of passengers.

Figure 13:
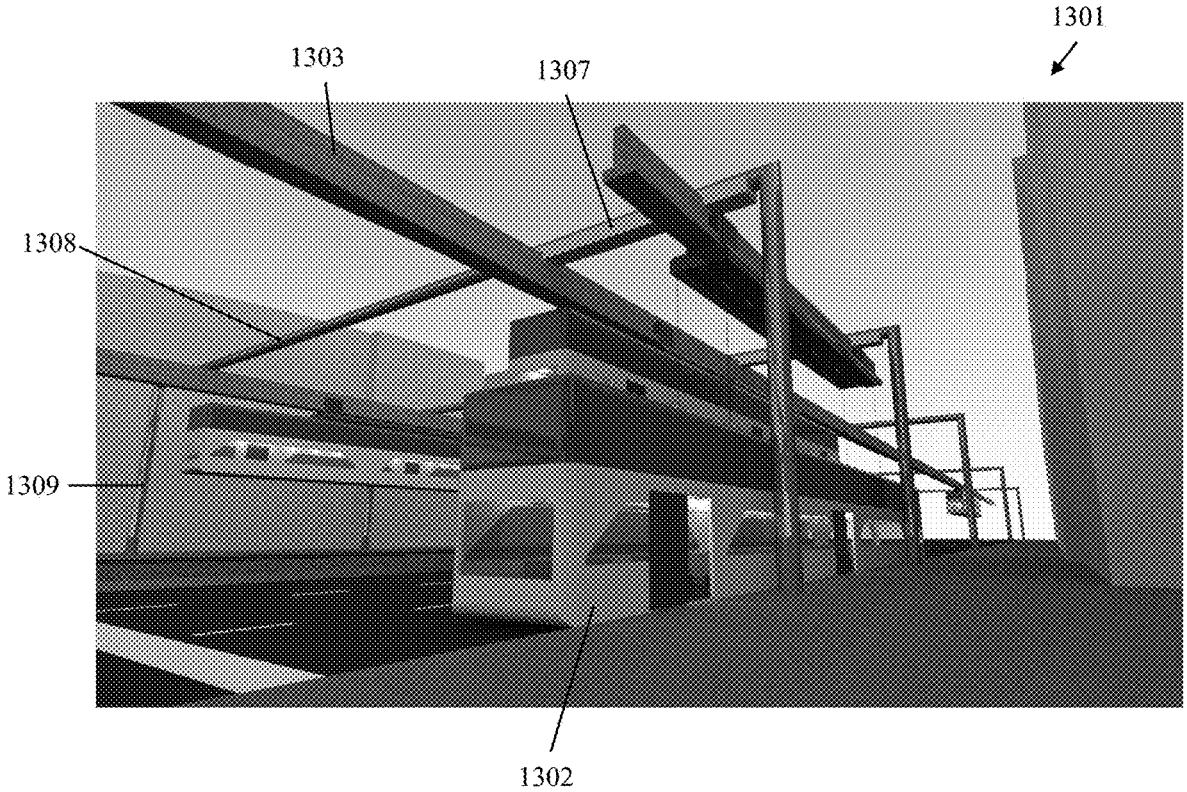
FIG. 13 illustrates the perspective view of a public transit system with a passenger car docked for loading and unloading, according to an aspect.

FIG. 13 illustrates the perspective view of a public transit system 1301 with a passenger car 1302 docked for loading and unloading, according to an aspect. For example, the public transit system 1301 may also use solar power to power the electric motor wheels and the other features of the system.

Figure 14:
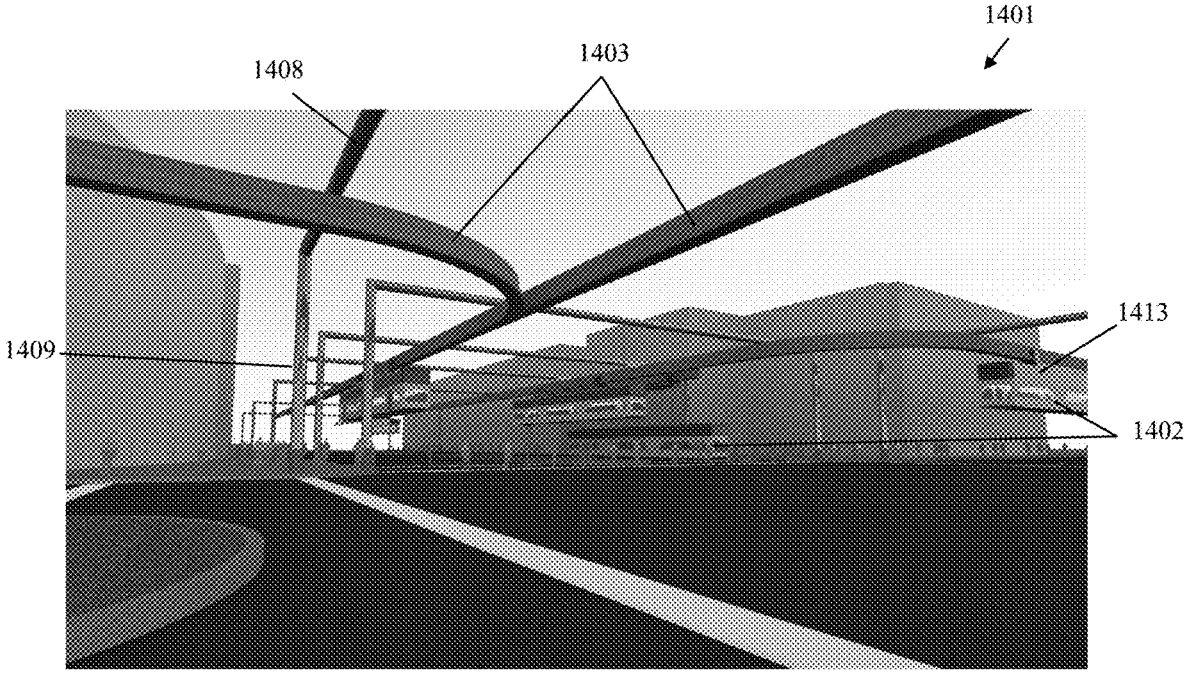
FIG. 14 illustrates the perspective view of a public transit system with multiple passenger cars, according to an aspect.

FIG. 14 illustrates the perspective view of a public transit system 1401 with multiple passenger cars 1402, according to an aspect. The public transit passenger car 1402 may follow the main rails 1403, which may be constructed over current city streets where the system is implemented. In addition, the public transit system 1401 may be used to provide supplementary revenue and a reduction in traffic because of it being a suspended system and its cargo section 1413. For example, the elevated passenger car 1402 may deliver mail and packages directly to the block of the packages' destination. There may be a cargo compartment 1413 above the passenger cabin 1414 and the cargo storage area 1413 may extend the full length and width of the passenger vehicle 1402. For example, the cargo compartment 1413 may have a moving floor for more convenient loading and unloading. The moving floor may be the entire length and width of the cargo compartment 1413 and allowing the first packages to be loaded on the moving floor to be delivered at the last designated stop for a passenger car. Parcel delivery services, such as FedEx, UPS, USPS, and many other companies that need to deliver small packages into city centers, may utilize and pay for this service.

In an example, the loading of the cargo compartment 1413 may occur at a standard metro car depot. A metro car depot may be used to hold, clean, and preform maintenance checks on the passenger car 1402. At the metro car depot, when the passenger cars 1402 are lowered to the ground, shippers may have preloaded containers, designed to fit within the cargo compartment 1413 and arranged by address and zip code for delivery. The passenger car 1402 with an assigned route may notify the shippers of its predetermined designated stops. For example, at the loading/unloading zones the passenger car 1402 lowers to the street to load and unload passengers while a rear cargo container door opens and the addressed packages for the current stop may be lowered to the ground through a mechanical means, such as the elevator described herein. The packages may then be distributed to waiting electric/peddle vehicles. Furthermore, unloading cargo may occur simultaneously while passengers are loading/unloading allowing the passenger car 1402 to depart on time.

The public transit system 1401 may accomplish these deliveries by having the participating companies packaging their products in an arrangement to be able to drop their deliveries at the depot for loading/unloading. For example, how current parcel delivery trucks are loaded. The companies also may have a schedule of where these passenger cars 1402, with their cargo, may be at any given time. Since the packages may be dropped off within a few city blocks of the recipient, the packages and mail may be delivered to their final destination more efficiently, thus reducing traffic congestion. In an example, the final delivery of these packages may be accomplished by small pedal driven or battery assisted vehicles because the parcels may be delivered to a relatively small geographic location. This also may allow for the deliveries to be non-polluting and environmentally friendly. This system may further reduce traffic by not needing large delivery trucks traveling long distances to deliver packages within city centers.

Figure 15A:
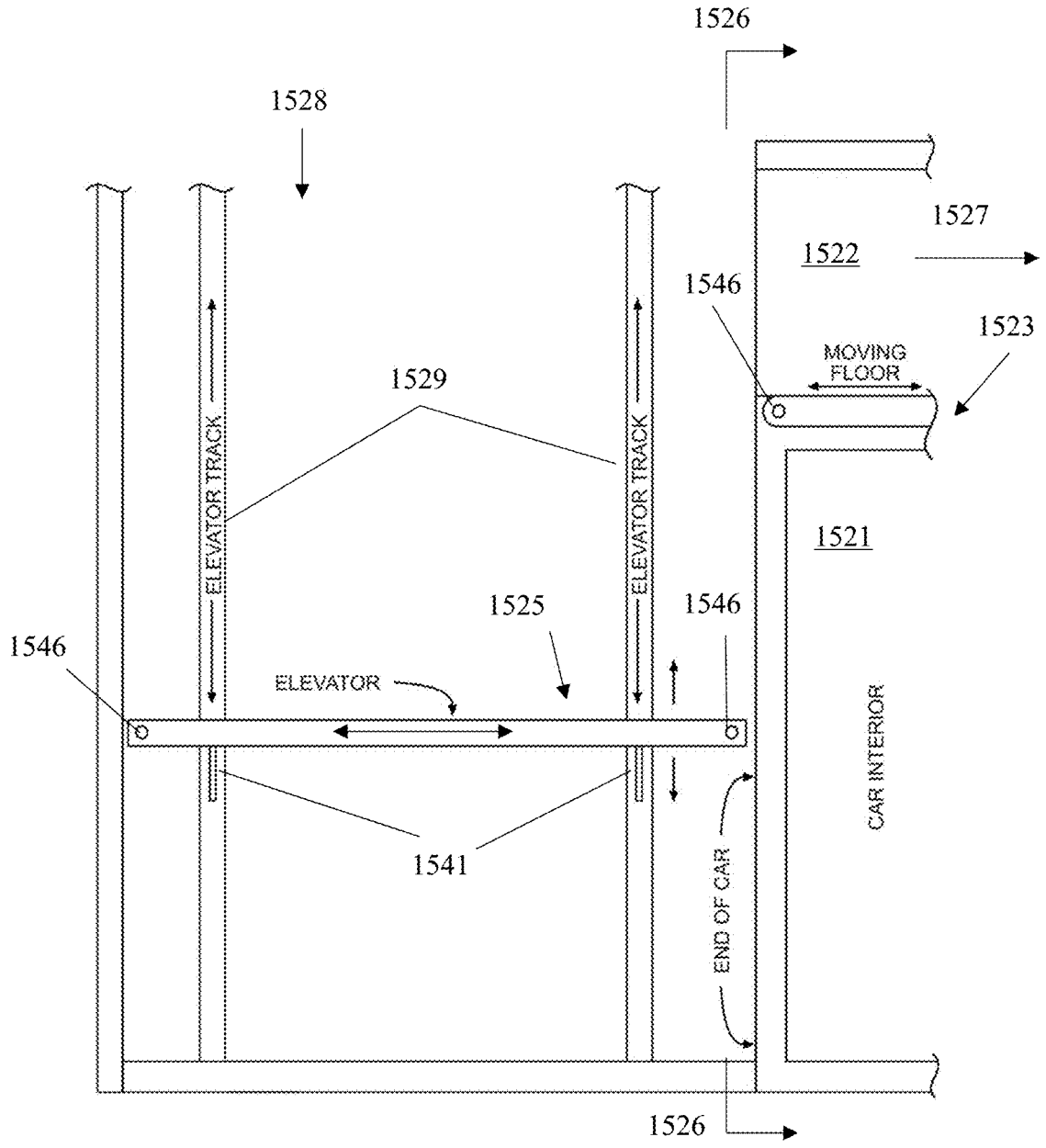
FIGS. 15A-15B illustrate cutaway interior views of the side and the rear, respectively, of a transit vehicle 1502, according to an aspect.
Figure 15B:
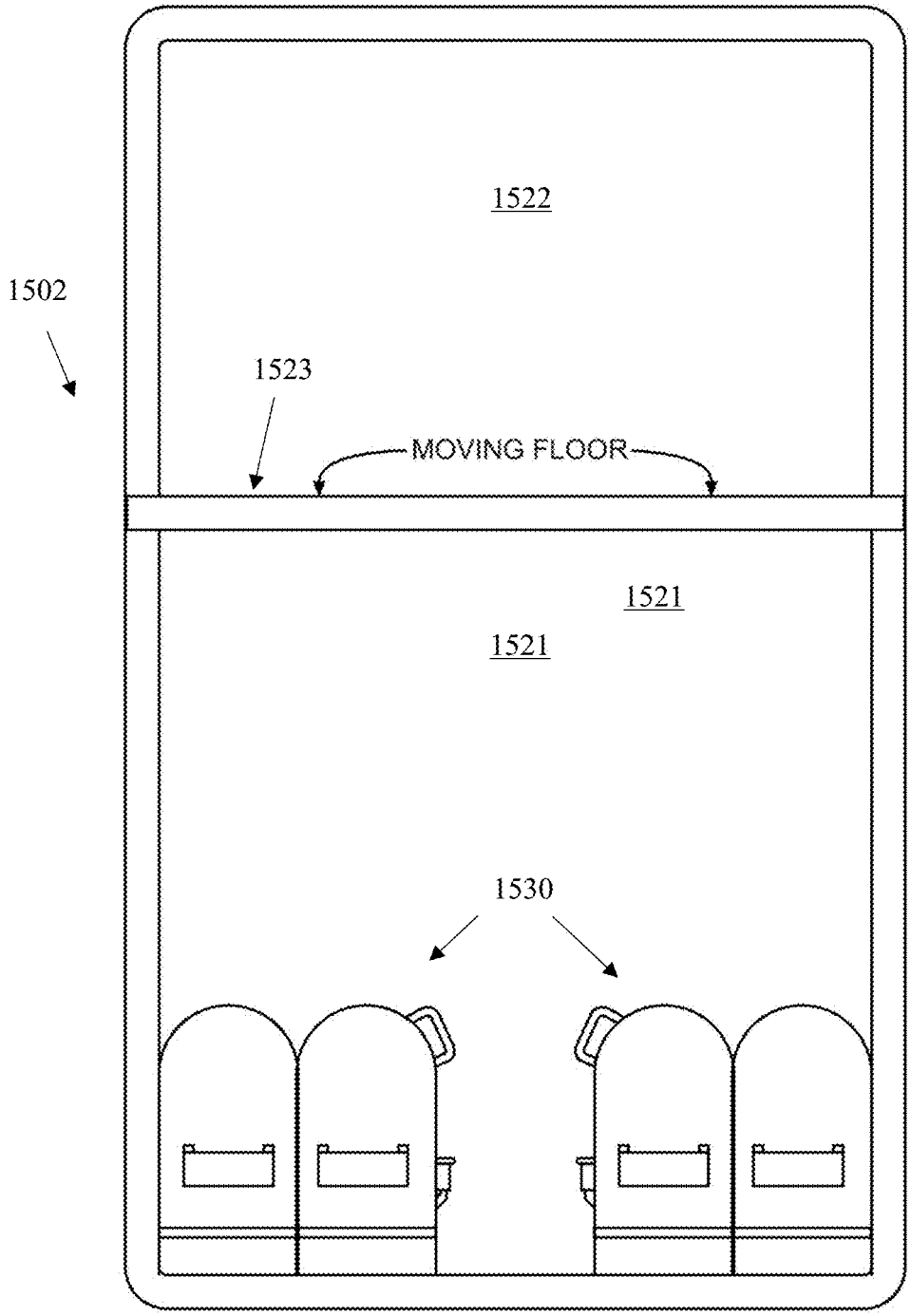

FIGS. 15A-15B illustrate cutaway interior views of the side and the rear, respectively, of a transit vehicle 1502, according to an aspect. FIG. 15B depicts the cutaway view of the rear of the interior of the transit vehicle 1502 along line 1526 of FIG. 15A. At least a portion of each transit vehicle 1502 may include a first level 1521, which can house the passenger seats 1530 (as shown in FIG. 15B), and a second level 1522 above the first level. The second level 1522 can be used as a cargo storage area, for the transport and storage of cargo, parcels, packages, and the like. The cargo can be set on a moving floor 1523. As shown in FIG. 15B, the moving floor 1523 can be used to transport the cargo from a first end of the car in the direction indicated by arrow 1527 to a second end 1528 of the car, which may be closer to an exterior of the car. The cargo can be moved by the moving floor 1523 further onto an elevator platform 1524 at the second end 1528. This can be accomplished by the moving floor 1523 being a conveyor belt, or rolling conveyor, or any other suitable method for transporting cargo across the floor in a horizontal direction, as indicated by the arrow provided above moving floor 1523 and onto the elevator platform 1525. Horizontal movement can be performed by rollers 1546, for example, turning a conveyer belt. The elevator platform may travel along an elevator track 1529 built into or provided at a wall of the car, such that the elevator platform 1525 can vertically move between the first level 1521 and the second level 1522. The elevator track 1528 can be, for example, threaded rods for raising and lowering the elevator platform 1525, or any other suitable means for vertical movement of the elevator platform. Additionally, the elevator platform 1525 can be reinforced on the wall of the car by braces 1541. In FIG. 15A, the elevator platform 1525 is depicted halfway between the first level 1521 and the second 1522, as it would be positioned while traveling up or down between the levels.

When the elevator platform is at the first level 1521, it can receive and load cargo, and then move vertically to the second level 1522. The elevator platform 1525 itself may also be provided with a conveyer or rollers, or any other suitable means, such that the floor of the elevator platform 1525 can move in the horizontal directions as indication by the arrow provided within 1525, such as by rollers 1546 turning a conveyer belt, or by any other suitable means, for moving the cargo onto the moving floor 1523 for transport. Similarly, once the elevator platform is at the second level 1522 and receives cargo from the moving floor 1523, it can move down to the first level 1521 to unload the cargo.

Figure 16:
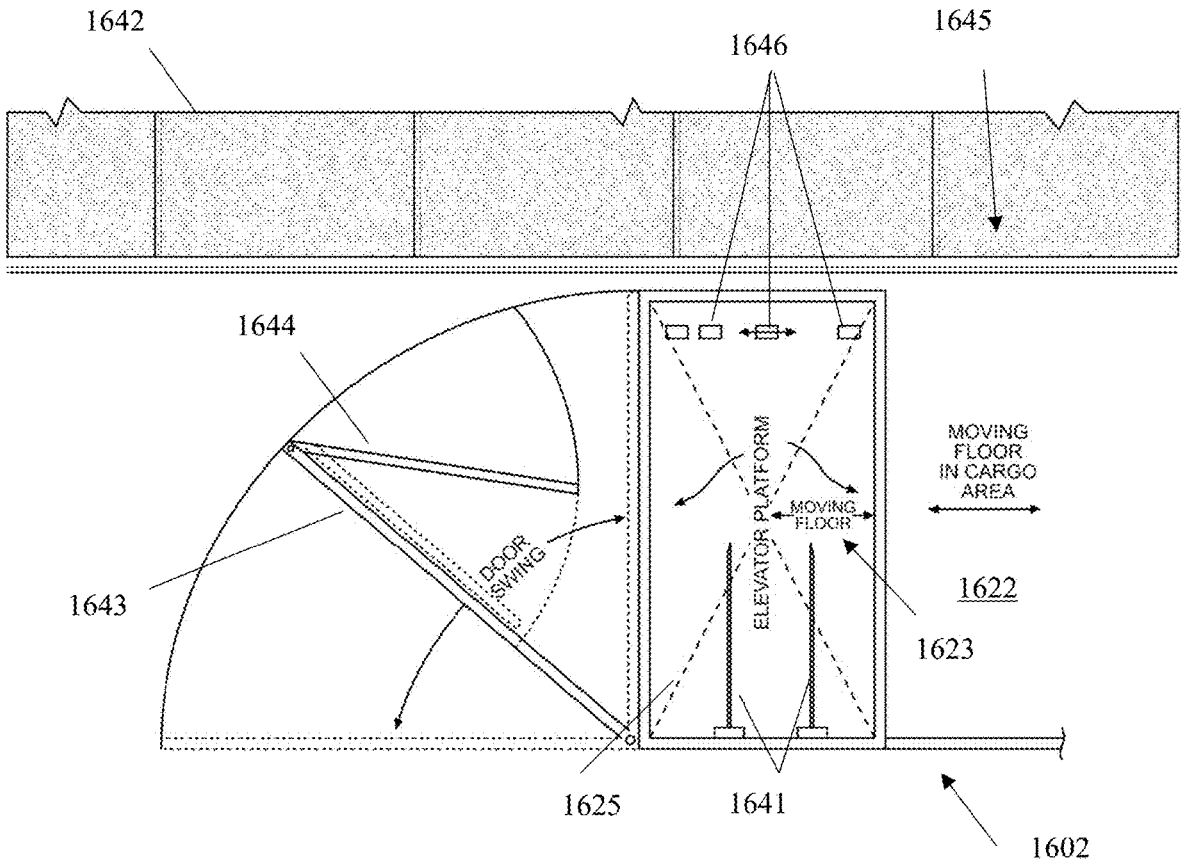
FIG. 16 illustrates a cutaway top-down view of a transit vehicle docked at a docking station, the vehicle having a cargo loading area on a moving floor, an elevator platform within a cargo loading area, and a door opening to an exterior of the vehicle, according to an aspect.

FIG. 16 illustrates a cutaway top-down view of a transit vehicle 1602 docked at a docking station, the vehicle having a cargo storage area on a moving floor 1623, an elevator platform 1625, and a door opening to an exterior of the vehicle, according to an aspect. For visual clarity, the elevator platform 1625 is represented in broken lines, such that the braces 1641 are visible underneath. Rollers 1646 can be provided on the elevator platform 1625 in order to move cargo back and forth. Cargo (not shown) can be moved between the elevator platform and the moving floor 1623 on the cargo storage area of the second level 1622, such as in the directions indicated by arrows 1646 on the rollers. The moving floor 1623 may function as a conveyer or similar moving surface within the cargo storage area to move cargo onto the elevator platform, and the elevator platform 1625 itself can also include moving elements such as a conveyer belt on rollers 1646.

When the vehicle 1602 is docked at street level for loading and unloading of passengers and/or cargo, it may be against a curb 1642. For the loading and unloading of cargo 1646, the car 1602 may include a rear door 1643. The rear door 1643 can swing outwards to open to the exterior of the car. The rear door 1643 can also include an additional swingout portion 1644. This swingout portion 1644 may, for example, protect the cargo during the loading and unloading process and provide a barrier between any persons operating the unloading and loading, and other persons or vehicles. Additionally, the swingout portion 1644 can lay against the side of the vehicle 1602, along the edge adjacent to the curb 1642, when the door is in a fully closed position. In some embodiments, the rear door 1643 may not include the swingout portion 1644.

The rear door 1643 may allow for simultaneously loading and unloading of cargo while passengers are also loading and unloading through a passenger door on another side of the car, such as at the region indicated by arrow 1645. This can allow for more efficient and faster loading and unloading procedures whenever the vehicle 1602 is stopped at a docking station.

Figure 17:
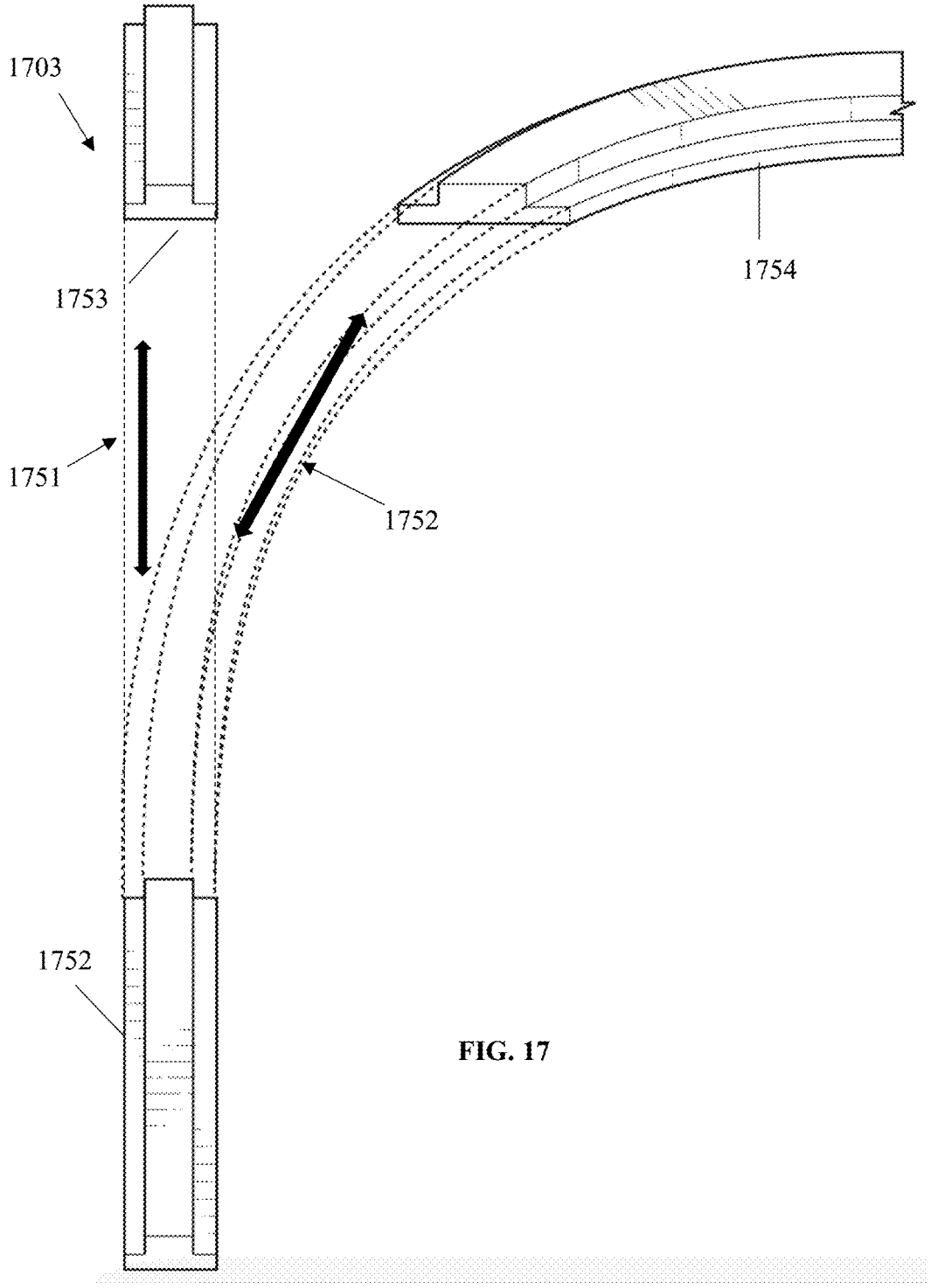
FIG. 17 illustrates a first example of an intersection track that can be part of the main track, used at an intersection of streets to allow for the transit vehicles to continue in a straight direction, or make a turn, according to an aspect.
Figure 18A:
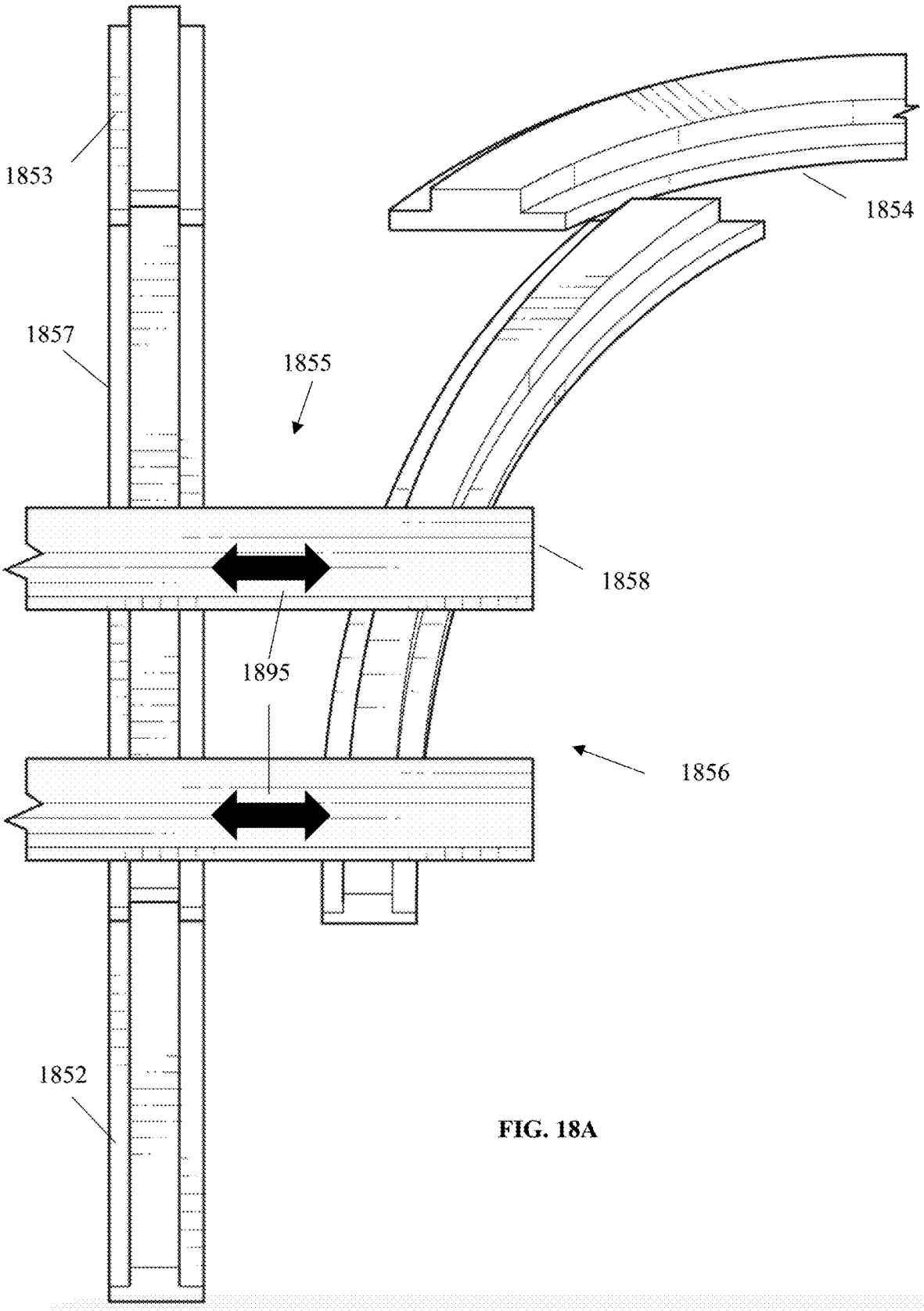
FIGS. 18A-18B illustrate the intersection portion of the main track, depicting a pivoting section completing the intersection track in a straight position and a curved position, respectively, according to an aspect.
Figure 18B:
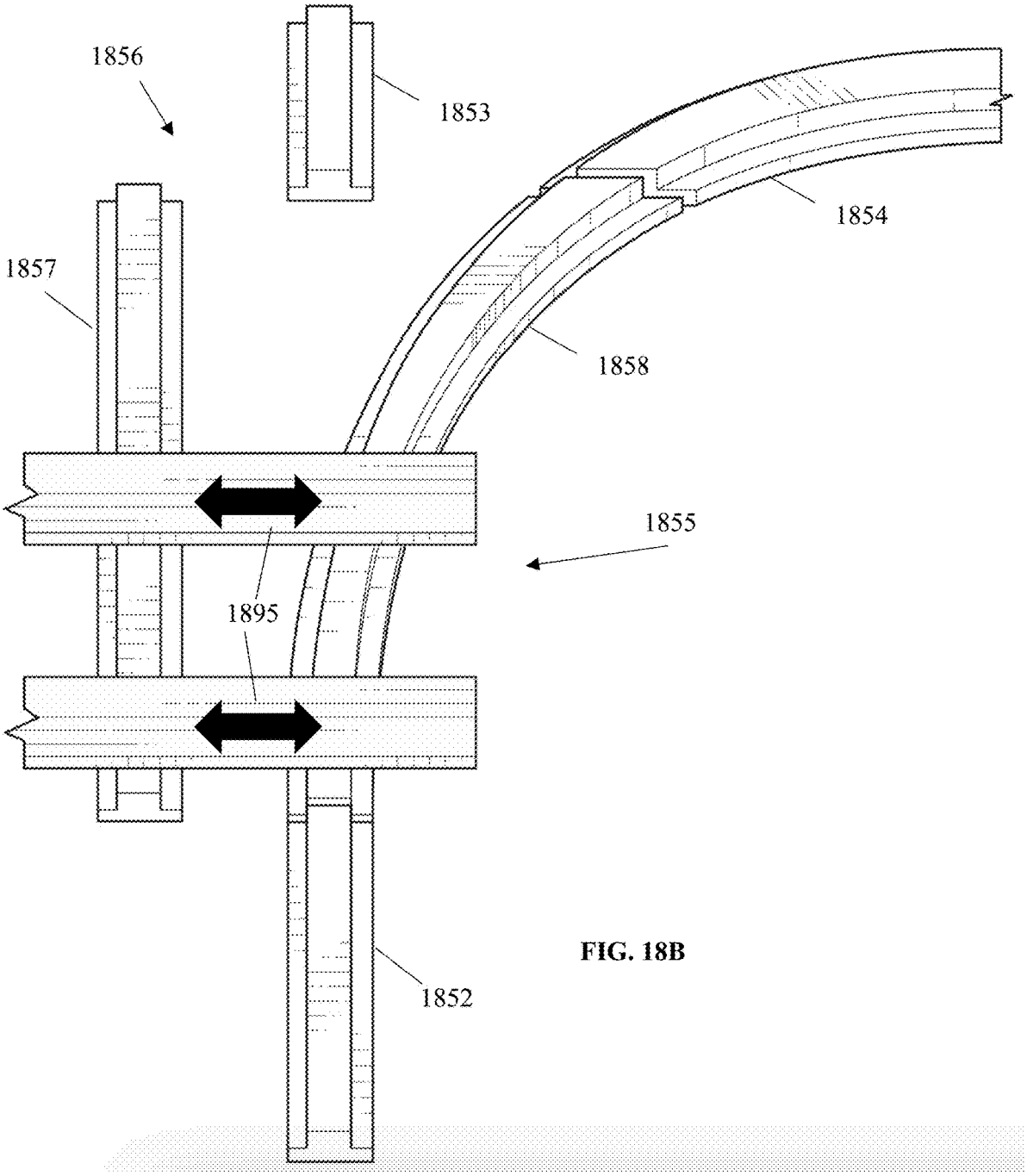

FIG. 17 illustrates portions of the main track that can be used with a movable intersection switch, according to an aspect. FIG. 17 depicts the pieces of a main track (such as the main track described when referring to at least FIG. 1) that may be provided around a movable intersection switch to complete the track portions depicted in broken lines, which is shown and described in further detail when referring to FIGS. 18A-18B. The movable intersection switches as disclosed herein can move in pivoting, sliding, or rotating motions in order to complete various portions of the main track of the suspended transit system. It should be understood that any such movements necessary to complete the tracks may be used by the movable intersection switches. Such movable intersection switches can be referred to as pivoting sections. Such pivoting sections can be used at an intersection of streets. In some embodiments, the intersection switches are sliding sections as shown in FIGS. 18A-18B to allow for the transit vehicles to continue in a straight direction as indicated by double-headed arrows 1751, or make a turn, as indicated by double-headed arrows 1752, according to an aspect. The main track 1703 may include pivoting sections that connect the track portions at areas indicated in broken lines, to allow for either a straight or turning direction. For example, track portions 1752 and 1753 can be connected and completed to allow for a vehicle to travel in a straight direction. As another example, track portions 1752 and 1754 can be connected and completed to allow for a vehicle to make a right turn when approaching from track portion 1752, or make a left turn when approaching from track portion 1754.

FIGS. 18A-18B illustrate a movable intersection switch 1856, depicting a sliding switch 1855 completing the intersection track in a straight position and a curved position, respectively, according to an aspect. FIG. 18A depicts the sliding switch 1855 completing track sections 1852 and 1853, using straight track portion 1857. FIG. 18B depicts the sliding switch 1855 completing track sections 1852 and 1854, using curved track portion 1858. The sliding switch can slide in the directions indicated by double-headed arrow 1895 in order to move between these positions, for example.

Figure 19A:
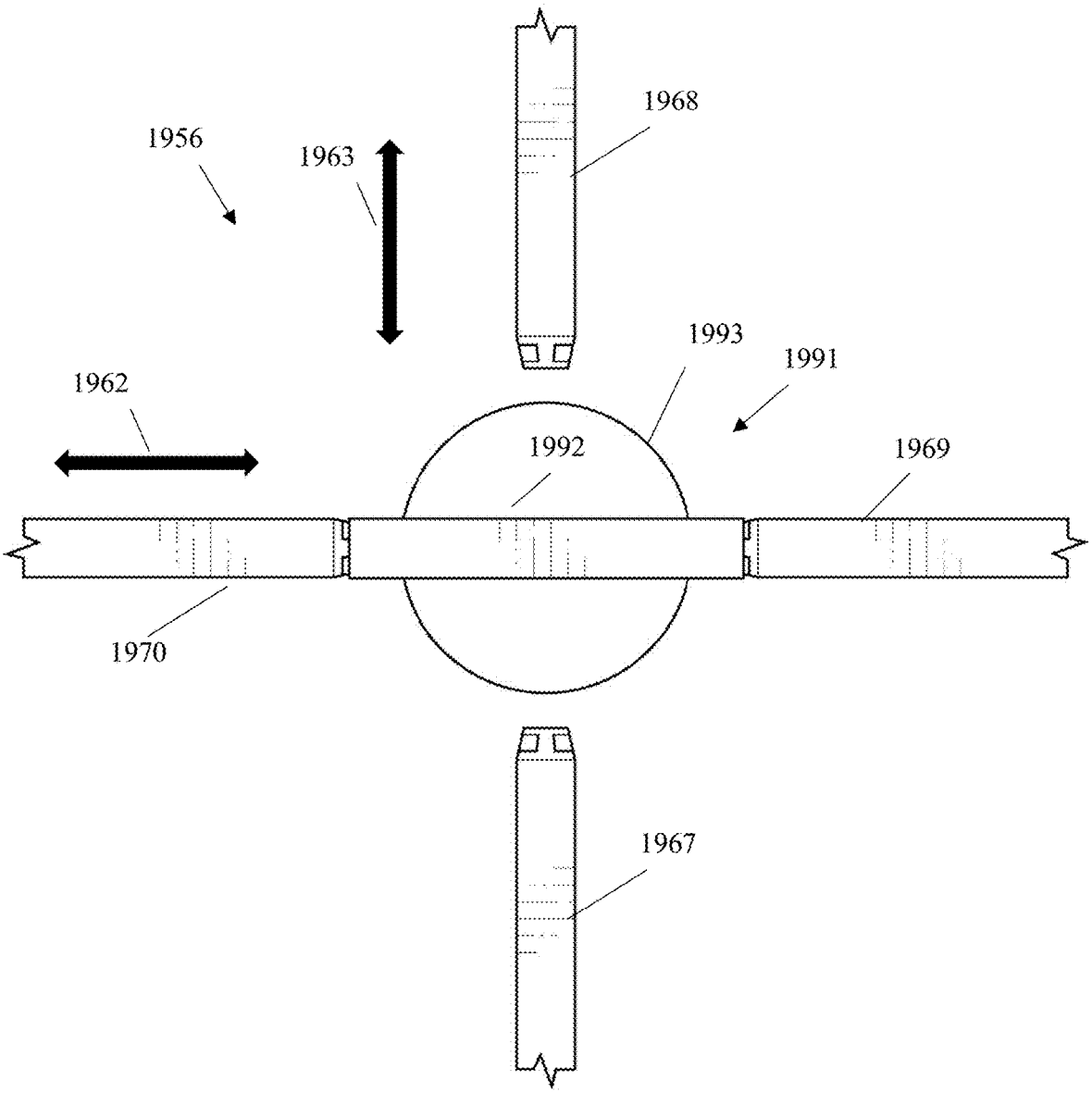
FIGS. 19A-19B illustrate another example of an intersection track that can be part of the main track, used at an intersection of streets to allow for transit vehicles to travel in a first set of parallel straight directions, or in a second set of parallel straight directions perpendicular to the first set of straight directions, according to an aspect.
Figure 19B:
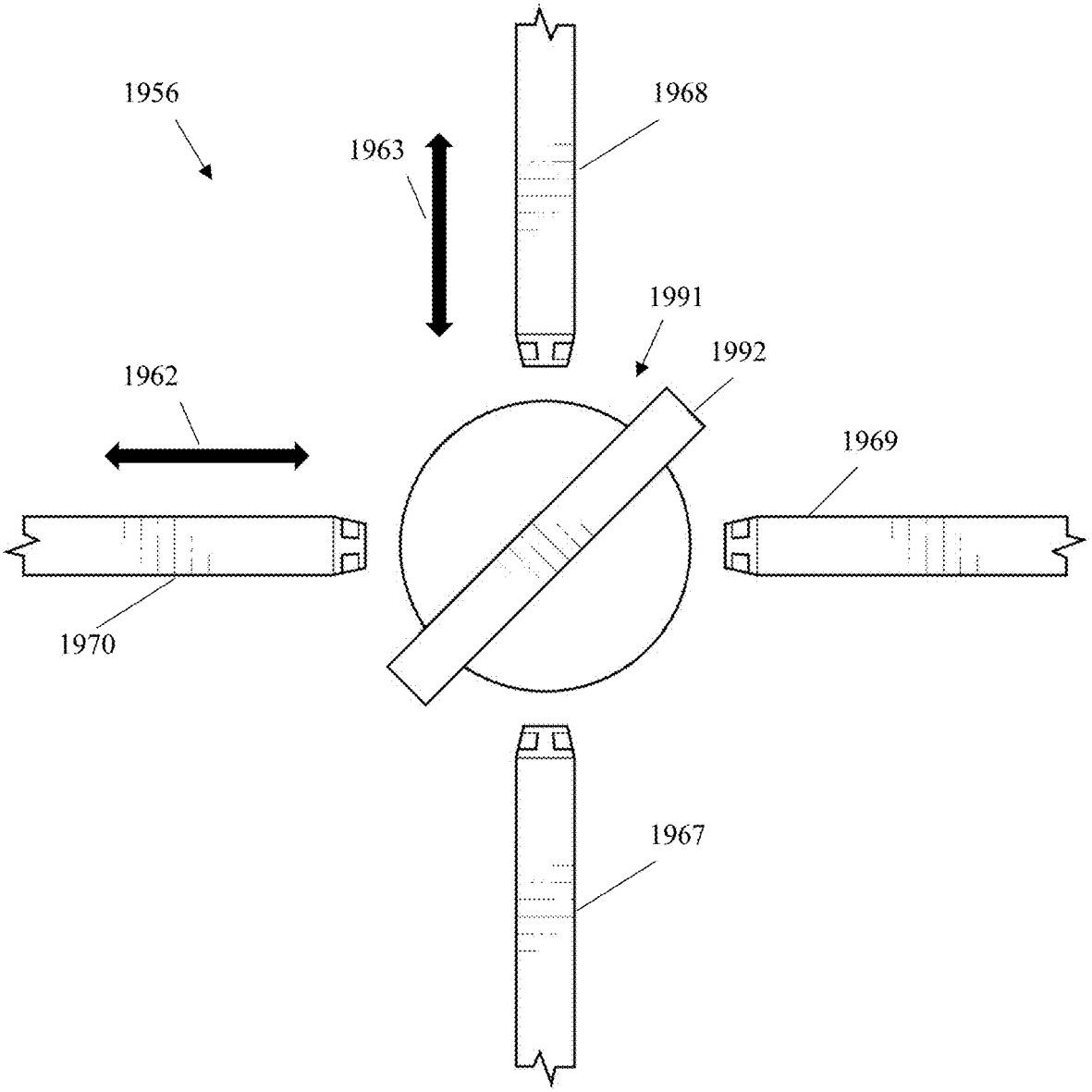

FIGS. 19A-19B illustrate another example of a movable intersection switch 1956 that can be part of the main track (as shown in at least FIG. 1, for example), used at an intersection of streets to allow for transit vehicles to travel in a first set of parallel straight directions indicated by double-headed arrows 1962, or in a second set of parallel straight directions indicated by double-headed arrows 1963, perpendicular to the first set of directions 1962, according to an aspect. In some embodiments, the movable intersection switch can be a rotating switch 1991 comprising a track 1992 that may be positioned at the center of the intersection, rotatable on a turntable 1993. This rotating switch 1991 can rotate to a first position to connect a first set of tracks comprising tracks 1967 and 1968, or to a second position to connect a second set of tracks that run perpendicular to the first set of tracks, comprising tracks 1969 and 1970. FIG. 19A depicts a first set of tracks connected by the rotating switch 1991, such that a vehicle can travel in the directions indicated by arrow 1962, while FIG. 19B depicts the rotating switch 1991 in between the first position and the second position, within which the second set of tracks can be connected. Such movable intersection switches and other such movable/pivoting switches can be used at intersections in order to save materials and costs in building the main track, and may add to the efficiency and space saving of the suspended transit system.

It should be understood that the intersection switches 1856, 1956 and the pivoting/sliding/rotating switches 1855, 1991 as depicted in FIGS. 18A-19B may be supported by the same support structure as the main track, described in further detail herein when referring to at least FIG. 1. It should also be understood that the pivoting section 1855, 1955 can be moved by a motor, electric motor, or any other suitable means when changes in the main track are necessary. For example, a sensor system may be used to sense the approach of a vehicle, and may receive signals or instructions from an operator or from a computer indicating which track is to be completed. Upon receipt of the instructions the motor can move the pivoting section into the appropriate position.

Figure 20A:
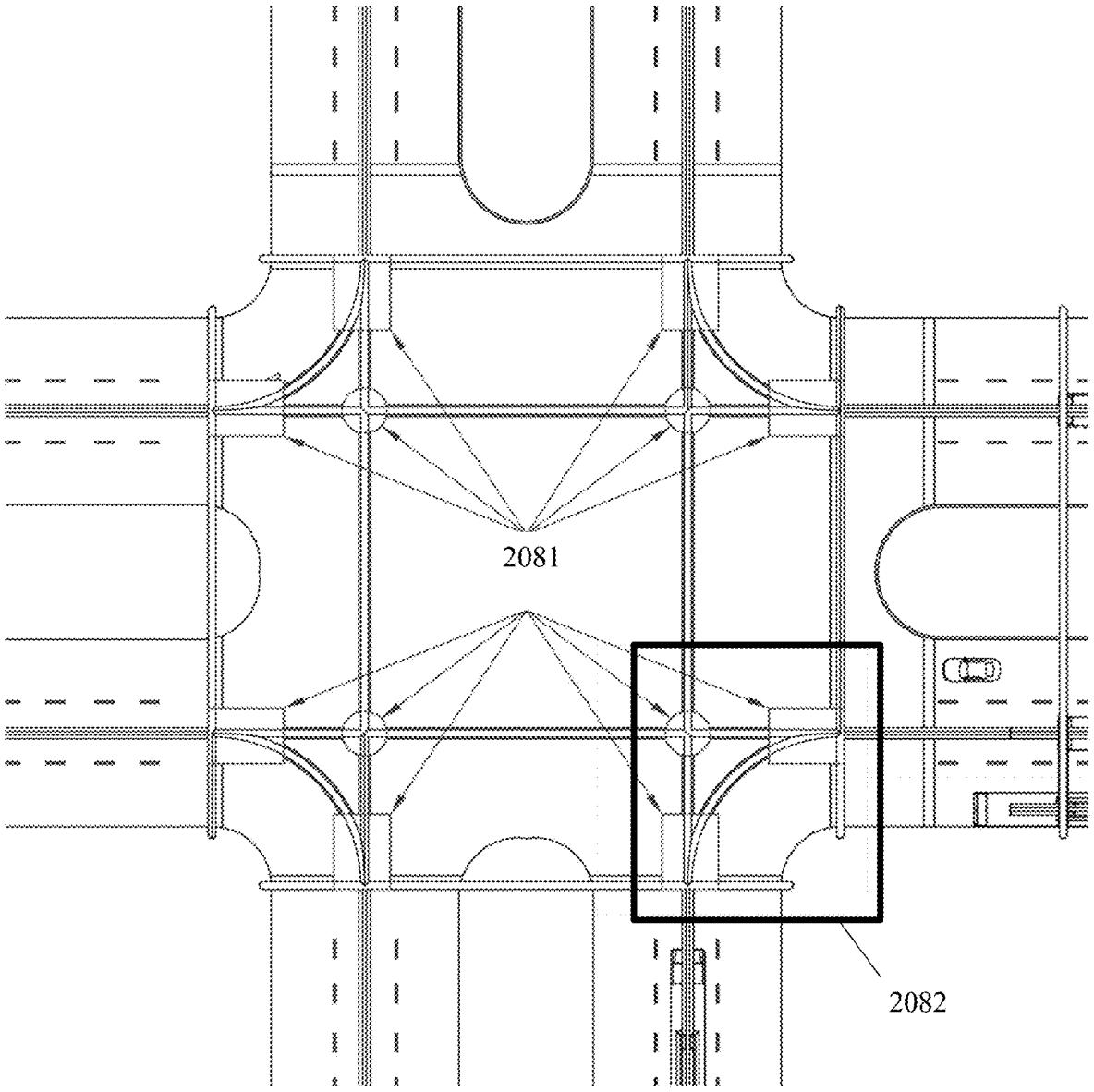
FIG. 20A illustrates an overhead view of a street intersection at which the movable intersection switches disclosed herein may be located within a suspended transit system, according to an aspect.

FIG. 20A illustrates an overhead view of a street intersection at which the movable intersection switches disclosed herein may be located within a suspended transit system, according to an aspect. The locations of such switches are depicted in the boxes 2081.

Figure 20B:
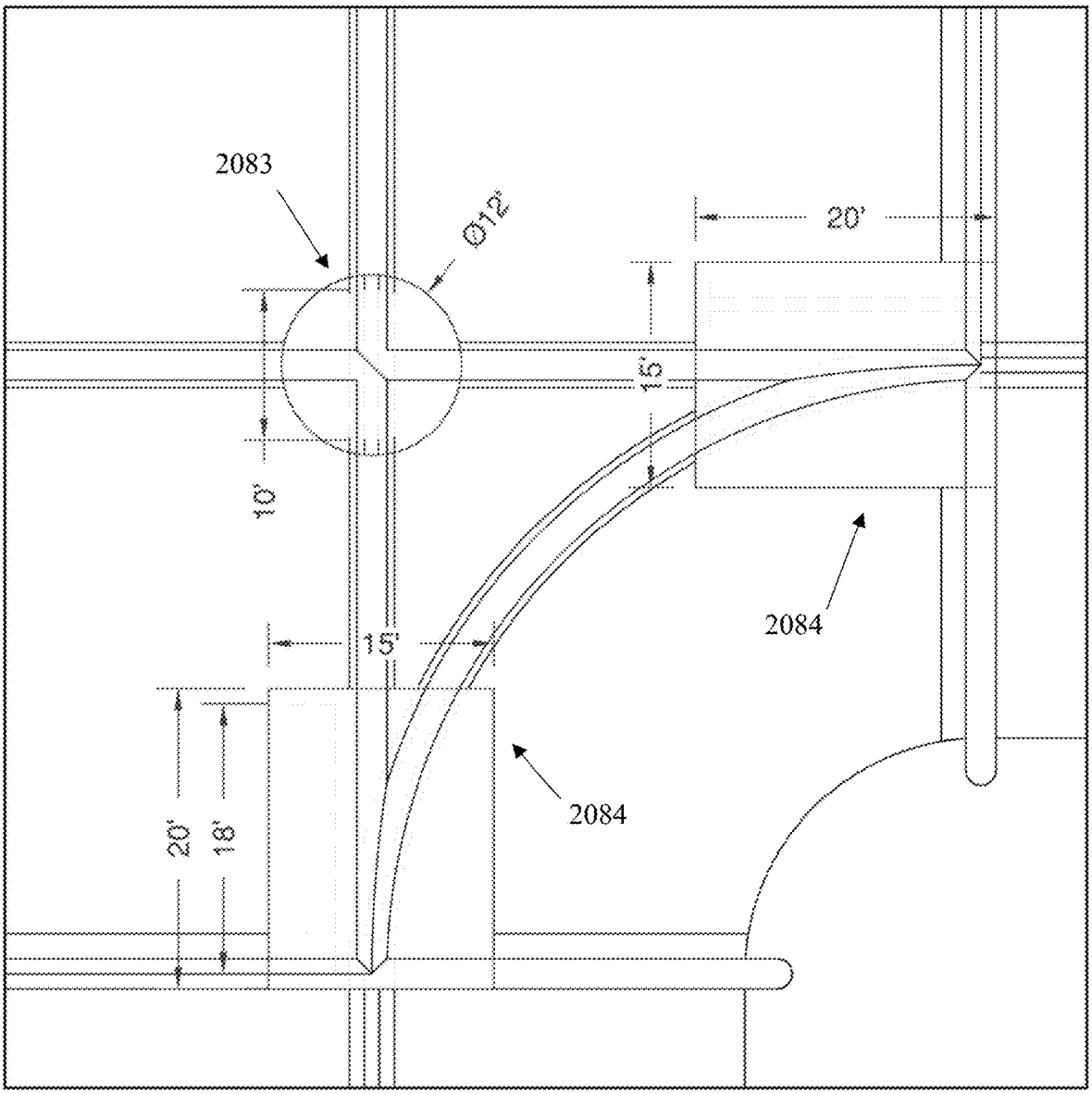
FIG. 20B illustrates a detailed enlarged view of the intersection of FIG. 20A, showing a single corner of a street intersection.

FIG. 20B illustrates a detailed enlarged view of section 2082 of FIG. 20A, showing a single corner of a street intersection, according to an aspect. Exemplary dimensions for areas of the intersection are provided on FIG. 20B. However, it should be understood that any suitable dimensions can be used for the size and placement of the tracks of the transit system within any size intersection of streets.

The movable intersection switch having a rotating switch as depicted in FIGS. 19A-19B may be provided at the circular area pointed out by arrow 2083. The movable intersection switch having a sliding switch as depicted in FIGS. 18A-18B may be provided at the rectangular areas pointed out by arrows 2084. Similar placement of such movable intersection switches can also be provided in the other areas pointed by arrows 2081 in FIG. 20A.

Figure 21A:
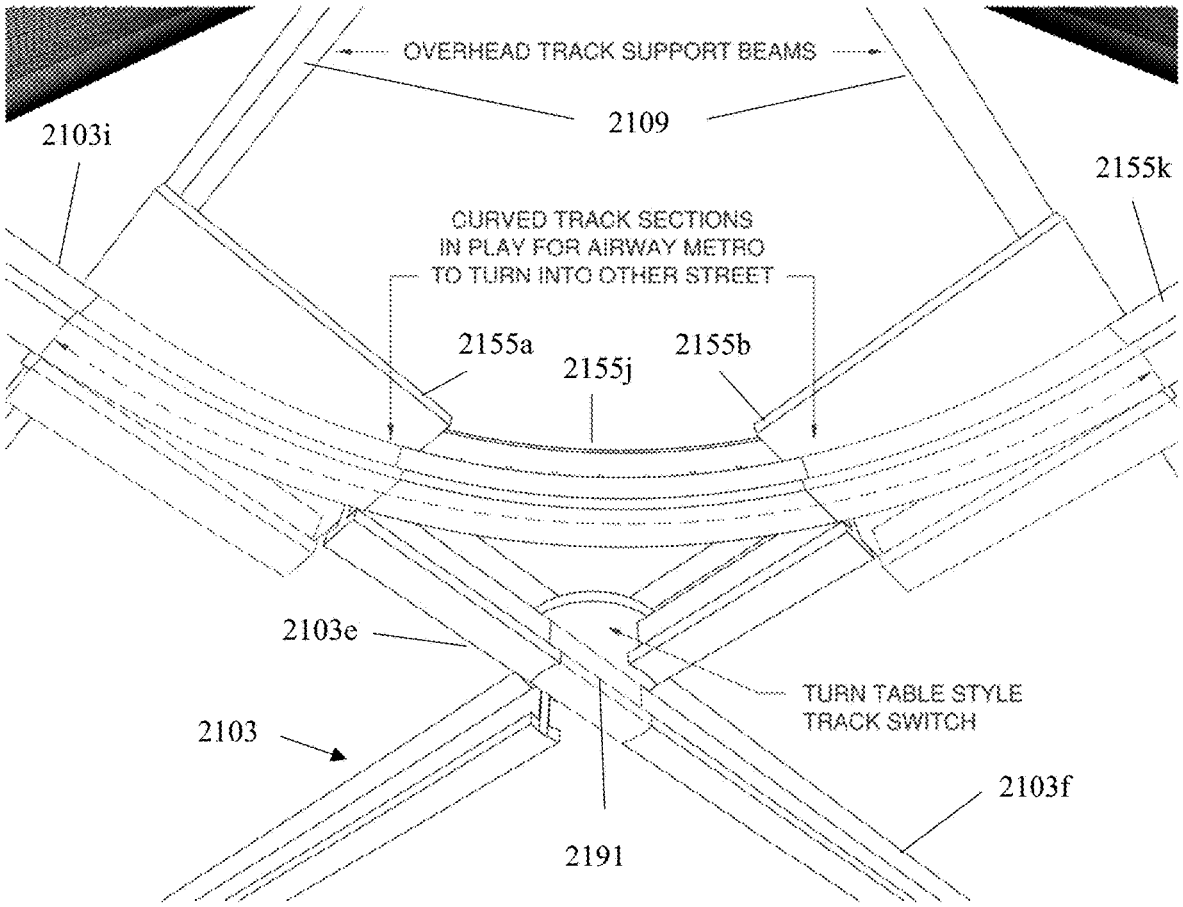
FIGS. 21A-21B illustrates bottom perspective views of a corner of an intersection, having a sliding switch and a rotating switch, according to an aspect.
Figure 21B:
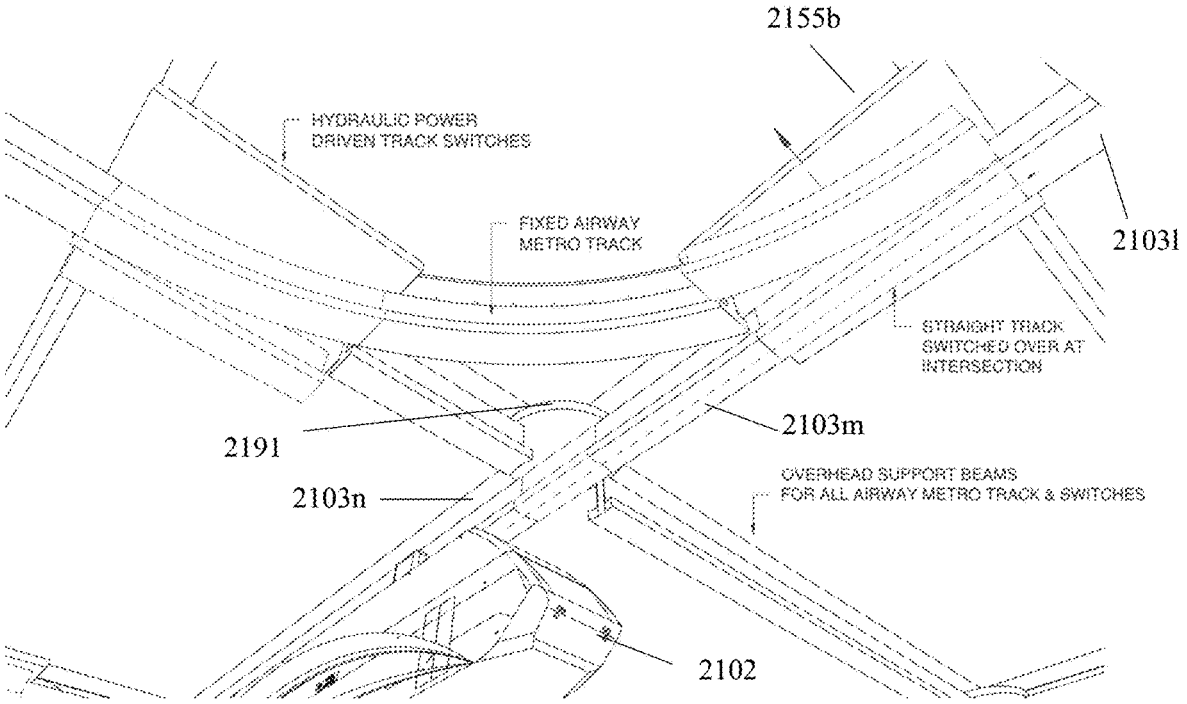

FIGS. 21A-21B illustrates bottom perspective views of a corner of an intersection, having a sliding switch and a rotating switch, according to an aspect. FIGS. 21A-21B depict two sliding switches 2155*a* and 2155*b*. FIG. 21A depicts both sliding switches in a position to compete the curved portions of the main track, shown by portions 2103*i*, 2103*j*, and 2103*k*. FIG. 21A also depicts the rotating switch 2191 rotated into a first position in order to connect the portions of the main track 2103 denoted by 2103*e* and 2103*f*. The sliding switches 2155*a*, 2155*b* and the rotating switch 2191 can each move into other positions as shown in FIG. 21B. FIG. 21B depicts the sliding switch 2155*b* moved into a second position to connect the track portions denoted by 2103*l* and 2103*m*. Track portion 2103*m* is also connected to the track portion denoted by 2103*n*, by the rotating switch 2191 moving into a second position. Thus, vehicle 2102 can continue traveling straight.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Throughout this description, the aspects, embodiments or examples shown should be considered as exemplars, rather than limitations on the apparatus or procedures disclosed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples.

What is claimed is:

1. A transit system for travel overhead of streets, comprising:

vehicles, comprising at least a first vehicle and a second vehicle;

a main track on which the vehicles travel, the main track having a suspended overhead rail over the streets by a support structure, such that the vehicles travel at an elevated level overhead of street level;

docking stations for the vehicles to lower to the street level for loading and/or unloading passengers and/or cargo;

a suspended two-position switch assembly at each docking station, having a first track portion suspended from the support structure, a second track portion suspended from the support structure, a cable elevator associated with the first track portion and cables in communication with the first vehicle and the cable elevator, enabling vertical movement of the first vehicle;

wherein the suspended two-position switch assembly allows for docking of the first vehicle by laterally sliding the first track portion from a traveling position on the main track to an unloading position while the second vehicle passes the docked first vehicle, by enabling lowering of the first vehicle from the elevated level to the street level, and simultaneously laterally sliding the second track portion to the traveling position on the main track, providing a track portion for the second vehicle on which to pass the first vehicle;

wherein the vehicles each comprise:

a first level comprising a seating section and a cargo loading area;

a second level above the first level, comprising a cargo storage having a first moving floor;

the cargo loading area comprising an elevator platform having a second moving floor, and an elevator track in an interior wall of the vehicle;

the elevator platform being capable of vertical movement between the first level and the second level via the elevator track;

and wherein the first moving floor and the second moving floor each are capable of horizontal movement to transport cargo.

2. The transit system of claim 1, the vehicles comprising electric motor drive wheels.

3. The transit system of claim 1, the vehicles comprising safety sensors for detection of other vehicles, people, or objects within the docking stations.

4. The transit system of claim 1, further comprising suspended slidable intersection switches at intersections of the streets, each suspended slidable intersection switch having a straight track portion suspended from the support structure and configured to complete the main track by sliding laterally to connect a first straight track section and a second straight track section to allow the vehicles to travel straight at intersections, and a separate curved track portion suspended from the support structure and configured to complete the main track by sliding laterally to connect the first straight track section and a curved track section to allow the vehicles to make a turn at intersections.

5. The transit system of claim 4, comprising motors for enabling movement of the suspended slidable intersection switches.

6. The transit system of claim 1, further comprising suspended rotating intersection switches at intersections of the streets, each suspended rotating switch configured to complete the main track by rotating between a first position and a second position.

7. A public transit system for travel overhead of streets, comprising:

vehicles, comprising at least a first vehicle and a second vehicle;

a main track on which the vehicles travel, the main track having an overhead rail suspended over the streets by a support structure, such that the vehicles travel at an elevated level overhead of street level;

docking stations for the vehicles to lower to the street level for loading and/or unloading passengers and/or cargo;

the main track comprising suspended slidable intersection switches at intersections of the streets, each suspended slidable intersection switch having a straight track portion suspended from the support structure and configured to slide laterally to complete the main track by connecting a first straight track section and a second straight track section and a separate curved track portion suspended from the support structure and configured to slide laterally to complete the main track by connecting the first straight track section and a curved track section, such that the vehicles are enabled to travel straight or make a turn at the intersections;

wherein the vehicles each comprise:

a first level comprising a seating section and a cargo loading area;

a second level above the first level, comprising a cargo storage having a first moving floor;

the cargo loading area comprising an elevator platform having a second moving floor, and an elevator track in an interior wall of the vehicle;

the elevator platform being capable of vertical movement between the first level and the second level via the elevator track;

and wherein the first moving floor and the second moving floor each are capable of horizontal movement to transport cargo.

8. The public transit system of claim 7, comprising motors for movement of the suspended slidable intersection switches.

9. The public transit system of claim 7, further comprising suspended rotating intersection switches at intersections of the streets, each suspended rotating switch configured to complete the main track by rotating between a first position and a second position.

10. The public transit system of claim 7, comprising a sensor for detection of suspended slidable intersection switches on a route of the vehicles traveling on the main track.

* * * * *